US009139028B1

(12) United States Patent
Otsuka et al.

(10) Patent No.: US 9,139,028 B1
(45) Date of Patent: Sep. 22, 2015

(54) PRINTING APPARATUS AND CONTROL PROGRAM FOR PRINTING APPARATUS

(71) Applicant: SEIKO EPSON CORPORATION, Tokyo (JP)

(72) Inventors: Shuji Otsuka, Shiojiri (JP); Isao Nomura, Azumino (JP); Hidenori Usuda, Matsumoto (JP); Toru Matsuyama, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/657,632

(22) Filed: Mar. 13, 2015

(30) Foreign Application Priority Data

Mar. 25, 2014 (JP) ..... 2014-061560

(51) Int. Cl.
*B41J 29/38* (2006.01)
*B41J 13/00* (2006.01)
*B41J 23/00* (2006.01)

(52) U.S. Cl.
CPC ..... *B41J 13/0009* (2013.01); *B41J 23/00* (2013.01)

(58) Field of Classification Search
CPC ..... B41J 19/142; B41J 2/07; B41J 19/202; B41J 11/009; B41J 11/003; B41J 11/42; B65H 2513/40; B65H 2220/03; B65H 2511/516; B65H 2220/01
USPC ..... 347/16, 37, 101, 104; 271/227, 275, 271/276, 278
See application file for complete search history.

(56) References Cited

U.S. PATENT DOCUMENTS 7,108,344 B2 * 9/2006 Yraceburu et al. ..... 347/9
7,914,112 B2 * 3/2011 Hayashi et al. ..... 347/39
8,029,083 B2 * 10/2011 Yamada ..... 347/16

FOREIGN PATENT DOCUMENTS

JP 2011-046118 A 3/2011

* cited by examiner

*Primary Examiner* — An Do
(74) *Attorney, Agent, or Firm* — Maschoff Brennan

(57) ABSTRACT

Provided is a printing apparatus including: a head unit that is provided with a discharge unit which discharges a liquid; a carriage into which the head unit is built; a power delivery unit that delivers at least a part of supplied power to the head unit; and a power supply unit that supplies power to the power delivery unit, in which the power delivery unit is provided with a first conductor and a second conductor, wherein power that is supplied from the power supply unit is delivered to the head unit through a coupling capacitance that is formed by the first conductor and the second conductor, and in which the power supply unit supplies different amounts of power to the power delivery unit depending on a type of a recording medium that is in a transport pathway.

7 Claims, 16 Drawing Sheets

FIG. 15

TBL

| RECORDING MEDIUM P | PAPER THICKNESS dp (mm) | SPECIFIC DIELECTRIC CONSTANT εr | SUPPLY POWER (Ws) | APPLIED VOLTAGE (Vs) |
|---|---|---|---|---|
| P11 (PHOTOGRAPHIC PAPER) | dp11: 0.15 | εr11: 2.5 | Ws11 | Vs11 |
| P12 (PHOTOGRAPHIC PAPER) | dp12: 0.15 | εr12: 3.0 | Ws12 | Vs12 |
| P13 (PHOTOGRAPHIC PAPER) | dp13: 0.20 | εr13: 2.5 | Ws13 | Vs13 |
| P14 (PHOTOGRAPHIC PAPER) | dp14: 0.20 | εr14: 3.0 | Ws14 | Vs14 |
| ⋮ | ⋮ | ⋮ | ⋮ | ⋮ |
| P21 (NORMAL PAPER) | dp21: 0.08 | εr21: 2.0 | Ws21 | Vs21 |
| P22 (NORMAL PAPER) | dp22: 0.08 | εr22: 2.5 | Ws22 | Vs22 |
| P23 (NORMAL PAPER) | dp23: 0.12 | εr23: 2.0 | Ws23 | Vs23 |
| P24 (NORMAL PAPER) | dp24: 0.12 | εr24: 2.5 | Ws24 | Vs24 |
| ⋮ | ⋮ | ⋮ | ⋮ | ⋮ |
| P31 (OHP) | dp31: 0.10 | εr31:3.0 | Ws31 | Vs31 |
| P32 (OHP) | dp32: 0.12 | εr32:3.0 | Ws32 | Vs32 |
| ⋮ | ⋮ | ⋮ | ⋮ | ⋮ |

PHOTOGRAPHIC PAPER (COATED PAPER)

NORMAL SHEET (NORMAL PAPER)

PRINTING APPARATUS AND CONTROL PROGRAM FOR PRINTING APPARATUS

The entire disclosure of Japanese Patent Application No. 2014-061560, filed Mar. 25, 2014 is expressly incorporated by reference herein.

BACKGROUND

1. Technical Field

The present invention relates to a printing apparatus and a control program for a printing apparatus.

2. Related Art

Regarding printing apparatuses such as ink jet printers, a configuration in which a head unit, which includes a discharge unit that discharges ink and a drive circuit that drives the discharge unit, is built into a carriage, which is capable of moving with respect to a main body portion of the printing apparatus, is known. In this kind of printing apparatus, it is common to connect the main body portion of the printing apparatus and the carriage using physical wiring in order to supply power to the head unit that is built into the carriage.

More specifically, methods that use a Flexible Flat Cable (FFC) as the wiring for power supply to the head unit, or use a timing belt that is connected to the carriage in order to move the carriage, are known (for example, refer to JP-A-2011-46118).

Meanwhile, since the carriage moves with respect to the main body portion of the printing apparatus when printing is executed, in a case in which power supply is performed using physical wiring such as an FFC or a timing belt, the position of the wiring also changes. In addition, since the head unit requires a large amount of power, in a case in which the position of the wiring that supplies such a large amount of power changes greatly, noise is generated from the wiring, and the noise spreads to each part of the printing apparatus, in some cases.

SUMMARY

An advantage of some aspects of the invention is to perform stable power supply to a head unit that is built into a carriage without using wiring of which the position is changed due to movement of the carriage.

According to an aspect of the invention, there is provided a printing apparatus that is capable of forming an image on a recording medium, which is in a transport pathway, by discharging a liquid onto the recording medium, the printing apparatus including a head unit that is provided with a discharge unit which discharges the liquid, a carriage into which the head unit is built, a power delivery unit that delivers at least a part of supplied power to the head unit, and a power supply unit that supplies power to the power delivery unit, in which the power delivery unit is provided with a first conductor that is provided on a side that is opposite to a side of the carriage with the transport pathway interposed therebetween, and a second conductor that is provided in the carriage, power that is supplied from the power supply unit is delivered to the head unit through a coupling capacitance that is formed by the first conductor and the second conductor, and the power supply unit supplies different amounts of power to the power delivery unit depending on a type of recording medium that is in the transport pathway.

In this case, since power is delivered to the head unit that is built into the carriage wirelessly using the coupling capacitance, it is possible to reduce a probability that noise will be generated in comparison with a case in which power is supplied using physical wiring. As a result of this, it becomes possible to prevent a circumstance in which printing quality deteriorates as a result of noise.

In addition, when power is delivered through the coupling capacitance in a case in which a recording medium is between the two conductors that form the coupling capacitance, a delivery efficiency of power changes depending on a type of recording medium. In a case in which a conveyance efficiency of power changes, there is a concern that there will be an excess or a deficiency in the power that is supplied to the head unit. In contrast to this, in the present embodiment, since the power supply unit supplies different amounts of power depending on the type of recording medium, a probability that there will be an excess or a deficiency in the power that is supplied to the head unit is reduced, and therefore, it becomes possible to provide stable power.

In the printing apparatus, the recording medium preferably includes a first recording medium and a second recording medium that have dielectric constants that are higher than air, the first recording medium is preferably thicker than the second recording medium, and a power that the power supply unit supplies to the power delivery unit in a case in which the recording medium that is in the transport pathway is the first recording medium is preferably smaller than a power that the power supply unit supplies to the power delivery unit in a case in which the recording medium that is in the transport pathway is the second recording medium.

In this case, a capacitance value of the coupling capacitance increases as the thickness of a recording medium that is between the two conductors that form the coupling capacitance increases, and as a result of this, a delivery efficiency of power to the head unit is increased. According to this aspect, since the power supply unit supplies different amounts of power depending on the thickness of the recording medium, it is possible to suppress a circumstance in which there is an excess or a deficiency in the power that is supplied to the head unit.

In addition, in the printing apparatus, the recording medium preferably includes a first recording medium and a second recording medium that have dielectric constants that are higher than air, the first recording medium preferably has a higher dielectric constant than the second recording medium, and a power that the power supply unit supplies to the power delivery unit in a case in which the recording medium that is in the transport pathway is the first recording medium is preferably smaller than a power that the power supply unit supplies to the power delivery unit in a case in which the recording medium that is in the transport pathway is the second recording medium.

In this case, a capacitance value of the coupling capacitance increases as the dielectric constant of a recording medium that is between the two conductors that form the coupling capacitance gets larger, and as a result of this, a delivery efficiency of power to the head unit is increased. According to this aspect, since the power supply unit supplies different amounts of power depending on the dielectric constant of the recording medium, it is possible to suppress a circumstance in which there is an excess or a deficiency in the power that is supplied to the head unit.

In addition, in the printing apparatus, the recording medium preferably includes a first recording medium, which is a synthetic resin medium, and a second recording medium, which is a paper medium, and a power that the power supply unit supplies to the power delivery unit in a case in which the recording medium that is in the transport pathway is the first recording medium is preferably smaller than a power that the power supply unit supplies to the power delivery unit in a case in which the recording medium that is in the transport pathway is the second recording medium.

In this case, a capacitance value of the coupling capacitance increases as the dielectric constant of a recording medium that is between the two conductors that form the coupling capacitance gets larger, and as a result of this, a delivery efficiency of power to the head unit is increased. According to this aspect, since a power that the power supply unit supplies to a synthetic resin medium, which has a high dielectric constant, during printing, is smaller than a power that the power supply unit supplies to a paper medium, which has a low dielectric constant, during printing, it is possible to suppress a circumstance in which there is an excess or a deficiency in the power that is supplied to the head unit.

In addition, in the printing apparatus, the recording medium preferably includes a first recording medium and a second recording medium, the first recording medium is preferably a paper medium that includes an ink reception layer configured to include synthetic silica, the second recording medium is preferably a paper medium that does not include the ink reception layer, and a power that the power supply unit supplies to the power delivery unit in a case in which the recording medium that is in the transport pathway is the first recording medium is preferably smaller than a power that the power supply unit supplies to the power delivery unit in a case in which the recording medium that is in the transport pathway is the second recording medium.

In this case, a capacitance value of the coupling capacitance increases as the thickness of a recording medium that is between the two conductors that form the coupling capacitance increases, and as a result of this, a delivery efficiency of power to the head unit is increased. According to this aspect, since a power that the power supply unit supplies to the first recording medium, which has an ink reception layer, during printing, is smaller than a power that the power supply unit supplies to the second recording medium, which does not have an ink reception layer and is thinner than the first recording medium, during printing, it is possible to suppress a circumstance in which there is an excess or a deficiency in the power that is supplied to the head unit.

In addition, according to another aspect of the invention, there is provided a printing apparatus that is capable of forming an image on a recording medium, which is in a transport pathway, by discharging a liquid onto the recording medium, the printing apparatus including a head unit that is provided with a discharge unit which discharges the liquid a carriage into which the head unit is built, a power delivery unit that delivers at least a part of supplied power to the head unit, and a power supply unit that supplies power to the power delivery unit, in which the power delivery unit is provided with a first conductor that is provided on a side that is opposite to a side of the carriage with the transport pathway interposed therebetween, and a second conductor that is provided in the carriage, power that is supplied from the power supply unit is delivered to the head unit due to electromagnetic coupling of the first conductor and the second conductor, and the power supply unit supplies different amounts of power to the power delivery unit depending on a type of recording medium that is in the transport pathway.

In this case, since power is delivered to the head unit that is built into the carriage wirelessly using electromagnetic coupling, it is possible to reduce a probability that noise will be generated in comparison with a case in which power is supplied using physical wiring. As a result of this, it becomes possible to prevent a circumstance in which printing quality deteriorates as a result of noise.

In addition, when power is delivered through the electromagnetic coupling in a case in which a recording medium is between the two conductors that form the electromagnetic coupling, a delivery efficiency of power may change depending on a type of recording medium. In a case in which a delivery efficiency of power changes, there is a concern that there will be an excess or a deficiency in the power that is supplied to the head unit. In contrast to this, in the present embodiment, since the power supply unit supplies different amounts of power depending on the type of recording medium, a probability that there will be an excess or a deficiency in the power that is supplied to the head unit is reduced, and therefore, it becomes possible to provide stable power.

In addition, according to still another aspect of the invention, there is provided a control program for a printing apparatus that includes a head unit that is provided with a discharge unit which discharges a liquid on a recording medium which is in a transport pathway, a carriage into which the head unit is built, a power delivery unit that delivers at least a part of supplied power to the head unit, a power supply unit that supplies power to the power delivery unit, and a computer, in which the power delivery unit is provided with a first conductor that is provided on a side that is opposite to a side of the carriage with the transport pathway interposed therebetween, and a second conductor that is provided in the carriage, and the power delivery unit delivers power that is supplied from the power supply unit to the head unit through a coupling capacitance that is formed by the first conductor and the second conductor. The control program causes the computer to function as a control unit that controls the power supply unit so that different amounts of power are supplied to the power delivery unit depending on a type of recording medium that is in the transport pathway.

In this case, since power is delivered to the head unit that is built into the carriage wirelessly using the coupling capacitance, it is possible to reduce a probability that noise will be generated in comparison with a case in which power is supplied using physical wiring. As a result of this, it becomes possible to prevent a circumstance in which printing quality deteriorates as a result of noise. In addition, since the power supply unit supplies different amounts of power depending on the type of recording medium, a probability that there will be an excess or a deficiency in the power that is supplied to the head unit is reduced, and therefore, it becomes possible to provide stable power.

BRIEF DESCRIPTION OF THE DRAWINGS

The invention will be described with reference to the accompanying drawings, wherein like numbers reference like elements.

FIG. 15 is an explanatory drawing that shows an example of a data configuration of a recording medium information table.

DESCRIPTION OF EXEMPLARY EMBODIMENTS

Hereinafter, aspects for implementing the invention will be described with reference to the drawings. However, in each figure, the dimensions and scales of each part have been altered from practical dimensions and scales as appropriate. In addition, since the embodiment that is mentioned below is a preferred specific example of the invention, various technically preferable limitations have been applied thereto, but the scope of the invention is not limited to these embodiments unless a feature that specifically limits the invention is disclosed in the following description.

1. CONFIGURATION OF INK JET PRINTER

Figure 1:
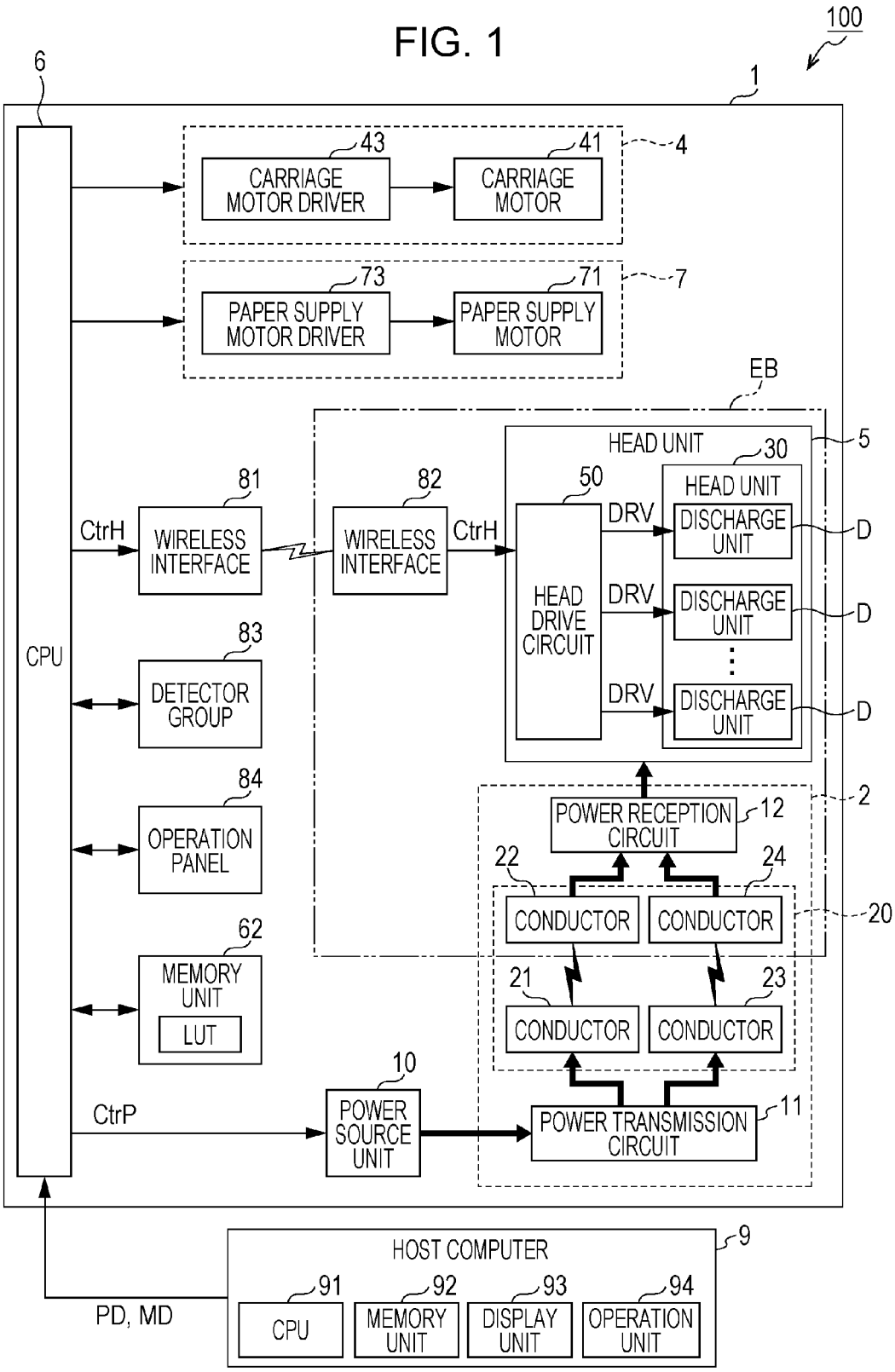
FIG. 1 is a block diagram that shows a configuration of an ink jet printer according to an embodiment of the invention.

FIG. 1 is a functional block diagram that shows a configuration of a printing system 100. As shown in this figure, the printing system 100 is provided with an ink jet printer 1 and a host computer 9.

The host computer 9 is for example, a personal computer, a digital camera or the like.

As shown in FIG. 1, the host computer 9 is provided with a Central Processing Unit (CPU) 91 that controls the operations of the host computer 9, a memory unit 92 that includes a Random Access Memory (RAM), a hard disk drive, and the like, a display unit 93 such as a display, and an operation unit 94 such as a keyboard or a mouse.

Printer driver programs that correspond to the ink jet printer 1 are stored in the memory unit 92. The CPU 91 carries out a halftone process and a rasterization process on image data that a user of the ink jet printer 1 intends to print by executing printer driver programs. As a result of this, the CPU 91 converts the image data and creates printing data PD that corresponds to a printing process by the ink jet printer 1.

Figure 2:
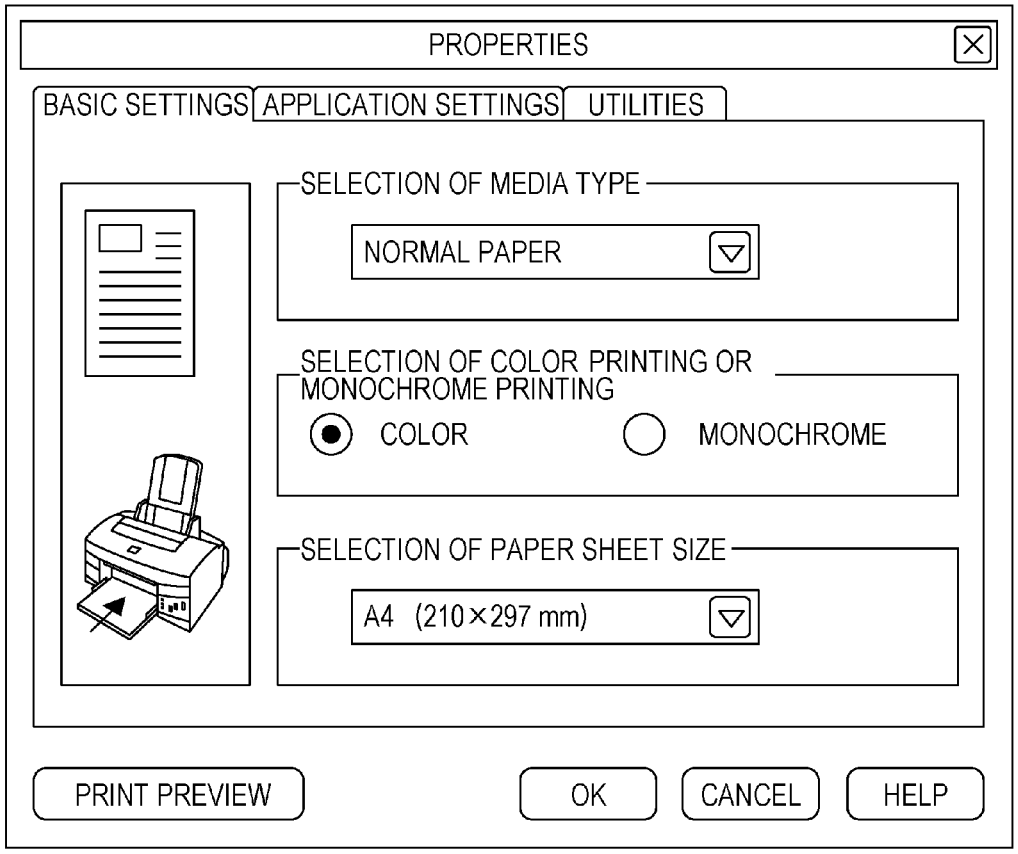
FIG. 2 is an explanatory drawing for describing a printing conditions selection screen.

In addition, the CPU 91 displays a printing conditions selection screen (a so-called printer control panel), which is illustrated in FIG. 2 on the display unit 93. On the printing conditions selection screen, a user of the ink jet printer 1 can select a type of a recording medium P on which an image should be printed by using the operation unit 94. In addition, on the printing conditions selection screen, a user of the ink jet printer 1 can select color printing or monochrome printing, a size of the recording medium P, and the like.

The CPU 91 creates recording medium data MD that shows a type of the recording medium P selected on the printing conditions selection screen.

Figure 3:
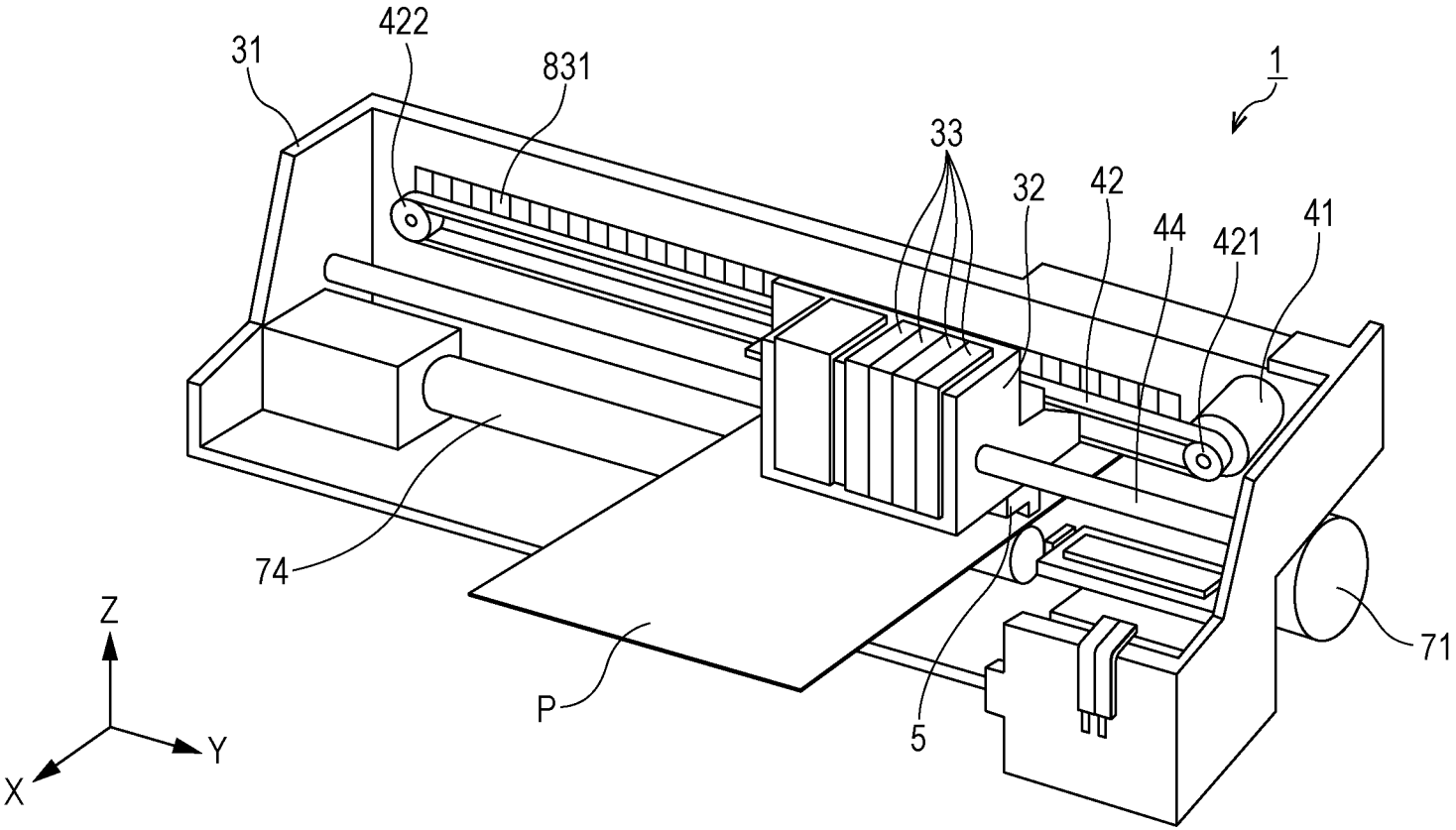
FIG. 3 is a perspective view that shows an overview of a configuration of the ink jet printer.
Figure 4:
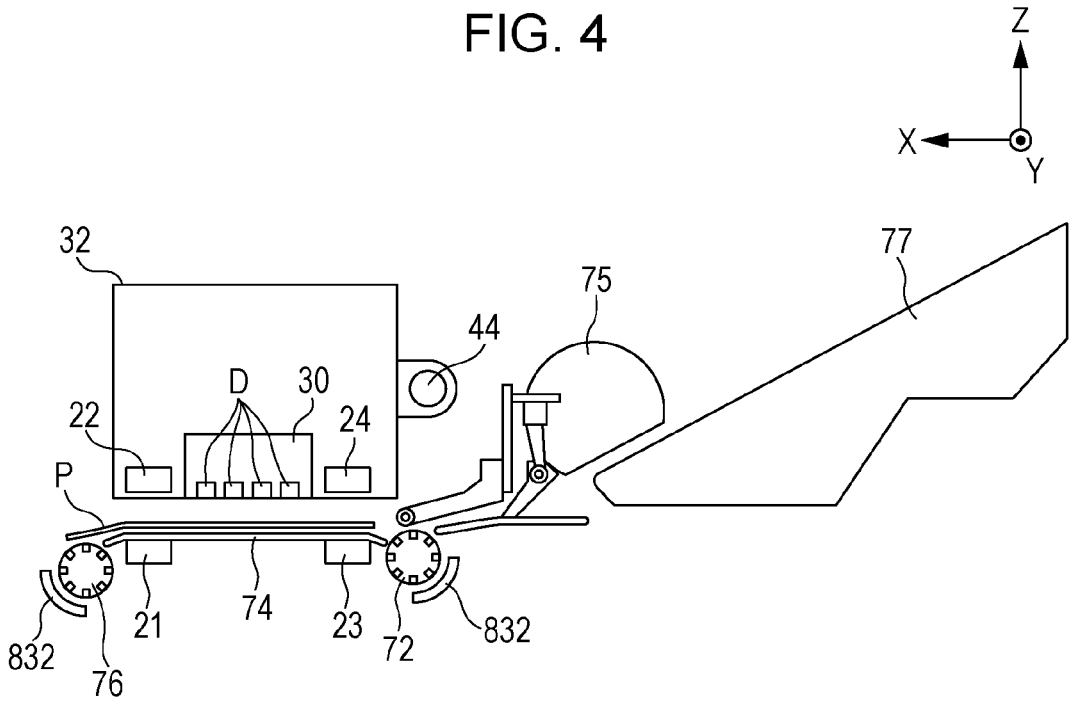
FIG. 4 is a schematic partial cross-sectional view of the ink jet printer.

FIG. 3 is a perspective view that shows a summary of a configuration of the ink jet printer 1, and FIG. 4 is a cross-sectional view that shows a summary of a cross-sectional structure of the ink jet printer 1. A configuration of the ink jet printer 1 will be described with reference to FIGS. 3 and 4 in addition to FIG. 1.

The ink jet printer 1 according to the present embodiment is an example of a "printing apparatus" that forms an image on the recording medium P by discharging ink (an example of a "liquid").

As shown in FIG. 3, the ink jet printer 1 is provided with a housing 31 that accommodates each constituent element of the ink jet printer 1, and a carriage 32 that moves in a reciprocating manner in a +Y direction and a −Y direction (an example of a "main scanning direction") with respect to the housing 31.

As shown in FIG. 3, a head unit 5, and four ink cartridges 33 are built into the carriage 32.

The four ink cartridges 33 that are built into the carriage 32 are ink cartridges that are provided to correspond one-on-one to the four colors of yellow (Yl), cyan (Cy), magenta (Mg) and black (Bk), and each ink cartridge 33 is filled with ink of a color that corresponds to each ink cartridge 33.

As shown in FIG. 1, the head unit 5 is provided with a head unit 30 that has M (M is a natural number of 4 or more) discharge units D, and a head drive circuit 50 that creates a drive signal DRV for driving each discharge unit D. The M discharge units D are divided into four groups so as to correspond one-to-one with the four ink cartridges 33. Each discharge unit D receives a supply of ink from a corresponding ink cartridge 33 among the four ink cartridges 33. Further, the inside of each discharge unit D is filled with ink that is supplied from a corresponding ink cartridge 33, and it is possible to discharge the ink with which a discharge unit D is filled via nozzles N of the corresponding discharge unit D on the basis of a drive signal DRV. Therefore, it is possible to discharge ink of a total of four colors from the M discharge units D, and full color printing is possible with the ink jet printer 1. The details of the head unit 5 will be described later.

Additionally, in the following description, there are cases in which elements that are built into the carriage 32 among the constituent elements of the ink jet printer 1 are referred to as "built-in components EB". In addition, there are cases in which constituent elements other than the carriage 32 and the built-in components EB among the constituent elements of the ink jet printer 1 are referred to as the "main body parts".

In addition, as shown in FIG. 1, the ink jet printer 1 is provided with a movement mechanism 4 for moving the carriage 32 in reciprocating manner in the +Y direction and the −Y direction.

As shown in FIGS. 1 and 3, the movement mechanism 4 includes a carriage motor 41 that acts as a drive source and moves the carriage 32 in a reciprocating manner, a carriage guiding shaft 44, both ends of which are fixed to the housing 31, a timing belt 42 that is driven by the carriage motor 41 and which extends in parallel with the carriage guiding shaft 44, and a carriage motor driver 43 for driving the carriage motor 41.

The carriage 32 is supported by the carriage guiding shaft 44 in a manner in which the carriage 32 is capable of moving freely in a reciprocating manner. In addition, a fixing tool 321 (refer to FIG. 7) that is fixed to the carriage 32 is fixed to a connecting part of the timing belt 42.

As shown in FIG. 3 (and in FIG. 7 which will be described later), the timing belt 42 is suspended (extends across an area) between a pulley 421 and a pulley 422. Further, when the carriage motor 41 drives the pulley 421 in a rotational manner, the timing belt 42 runs in forward and backward in accordance with the rotation of the pulley 421. More specifically, when the pulley 421 is driven to rotate, a portion of the timing belt 42 that is on an upper side (a +Z direction) of the pulleys 421 and 422 moves in one direction of the +Y direction and the −Y direction, and a portion of the timing belt 42 that is on a lower side (a −Z direction) of the pulleys 421 and 422 moves in the other direction of the +Y direction and the −Y direction. Therefore, as a result of the carriage motor 41 driving the pulley 421 in a rotational manner, a connecting part of the timing belt 42 (a portion of the timing belt 42 that is fixed to the fixing tool 321 of the carriage 32) moves in either the +Y direction or the −Y direction, and as a result of this, the carriage 32 moves in a reciprocating manner in the +Y direction and the −Y direction while being guided by the carriage guiding shaft 44.

As shown in FIG. 1, the ink jet printer 1 is provided with a paper supply mechanism 7 for supplying and ejecting the recording medium P.

As shown in FIGS. 1 and 3, the paper supply mechanism 7 is provided with a paper supply motor 71 that acts as a drive source of the paper supply mechanism 7, a paper supply motor driver 73 for driving the paper supply motor 71, a tray 77 on which the recording medium P is mounted, a platen 74 that is provided on a lower side (the −Z direction) of the carriage 32, paper supply rollers 72 and 75 for supplying the recording medium P onto the platen 74 one at a time by rotating as a result of an operation of the paper supply motor 71, and a paper ejection roller 76 that transports the recording medium P that is on the platen 74 to an ejection opening (not shown in the drawings) by rotating as a result of an operation of the paper supply motor 71. The paper supply mechanism 7 can transport the recording medium P in a +X direction in the drawings. Hereinafter, a pathway along which the recording medium P is transported by the paper supply mechanism 7 will be referred to as a "transport pathway".

The ink jet printer 1 executes a printing process that forms an image on a recording medium P that is transported in the transport pathway (or more precisely, on the platen 74) by discharging ink onto the recording medium P from a plurality of discharge units D.

As shown in FIG. 1, the ink jet printer 1 is provided with a CPU 6 that controls the operations of each unit of the ink jet printer 1, a memory unit 62 that stores various items of information, a power source unit 10 (an example of a "power supply unit") that supplies power to each unit of the ink jet printer 1, a power transmission unit 2 (an example of a "power delivery unit") for delivering power that is supplied from the power source unit 10 to the head unit 5, a detector group 83 that detects positions of the carriage 32 and the recording medium P, and an operation panel 84 that is configured of a display unit that displays error messages or the like, an operation unit which is configured by various switches or the like, and the like.

The memory unit 62 is provided with Electrically Erasable Programmable Read-Only Memory (EEPROM), which is a type of non-volatile semiconductor memory, and which temporarily stores the printing data PD and the recording medium data MD supplied from the host computer 9 through an interface unit that has been omitted from the drawings, in a data storage region, Random Access Memory (RAM) which temporarily stores data that is required during the execution of various processes such as a printing process, or temporarily deploys a control program for executing various processes such as a printing process, and PROM, which is a type of non-volatile semiconductor memory, and which stores a control program for controlling each unit of the ink jet printer 1, a recording medium information table TBL which will be described later and the like.

The CPU 6 causes the printing data PD and the recording medium data MD, which is supplied from the host computer 9 through an interface unit that has been omitted from the drawings, to be stored in the memory unit 62. Further, the CPU 6 executes a printing process that forms an image that corresponds to the printing data PD on the recording medium P by controlling the operations of the head unit 5, the power source unit 10, the movement mechanism 4 and the paper supply mechanism 7 on the basis of the printing data PD and the recording medium data MD.

More specifically, the CPU 6 creates a control signal CtrH for driving each discharge unit D by controlling the operation of the head drive circuit 50 on the basis of the printing data PD and the recording medium data MD, and supplies the control signal CtrH to the head unit 5 via a wireless communication between a wireless interface 81, which is provided on an outer side (a housing 31 side) of the carriage 32 as a main body part, and a wireless interface 82, which is built into the carriage 32 as a built-in component EB. As a result of this, the CPU 6 controls whether or not ink is discharged from each discharge unit D, and an ink discharge amount and a discharge timing in a case in which ink is discharged by controlling the operation of the head drive circuit 50.

In addition, the CPU 6 creates control signals for controlling operations of the carriage motor driver 43 and the paper supply motor driver 73 on the basis of various data that is stored in the memory unit 62 and a detection value from the detector group 83, and outputs the various created control signals. As a result of this, the CPU 6 drives the carriage motor 41 so that intermittent sending of the recording medium P is performed one sheet at a time in the sub-scanning direction (the +X direction) through control of the operation of the carriage motor driver 43, and in addition, drives the paper supply motor 71 so that the carriage 32 moves in a reciprocating manner in the main scanning direction (the +Y direction and a −Y direction) through control of the operation of the paper supply motor driver 73.

In this manner, the CPU 6 executes a printing process that forms an image that corresponds to the printing data PD on the recording medium P by adjusting a size and a disposition of dots that are formed by ink discharged onto the recording medium P through control of the operations of each unit of the ink jet printer 1.

The detector group 83 includes a linear encoder 831, and a rotary encoder 832.

The linear encoder 831 includes a scale on which a striped pattern is printed at predetermined intervals in the main scanning direction, and a pair of a light emitting element and a light receiving element that are disposed on the scale of the carriage 32 in positions in which the elements face one another (only the scale is shown in FIG. 3). The linear encoder 831 detects an amount of movement of the carriage 32 in the main scanning direction, and outputs a detection result.

The rotary encoder 832 includes a scale on which a striped pattern is printed at predetermined angles in a direction of rotation of the paper supply roller and the paper ejection roller, and a pair of a light emitting element and a light receiving element that are disposed on the scale in positions in which the elements face one another (refer to FIG. 4). The rotary encoder 832 detects an amount of rotation of the paper supply roller and the paper ejection roller, and outputs a detection result. The CPU 6 can calculate a position of the carriage 32 in a Y axis direction on the basis of the detection result from the linear encoder 831, and can calculate a position of the recording medium P that is in the transport pathway in an X axis direction on the basis of the detection result from the rotary encoder 832.

The power source unit 10 is provided on the outer side (the housing 31 side) of the carriage 32 as a main body part, and supplies power to the built-in components EB such as the head unit 5 through the power transmission unit 2.

While power is calculated as the product of voltage and current, in order to deliver power to a load, a power supply pathway through which a current flows from a power source at which power is generated toward a load, and a power discharge pathway in which a return current flows from the load to the power source, are required. That is, generally, a power source is electrically connected to a load through a power supply pathway and a power discharge pathway, and a power source voltage is applied to the power supply pathway and the power discharge pathway.

The power source unit 10 according to the present embodiment is connected to a residential AC electrical outlet or the like through an electric cord or the like, and generates an AC voltage. Further, by supplying a first power source signal to the power supply pathway and a second power source signal to the power discharge pathway, the power source unit 10 applies a power source voltage that is given as a difference in potential between the first power source signal and the second power source signal to the power supply pathway and the power discharge pathway.

Additionally, in the present embodiment, the term "supply power" includes the application of a power source voltage to the power supply pathway and the power discharge pathway by supplying a power source signal to at least one of the power supply pathway and the power discharge pathway.

In addition, although this will be described in more detail later, the potentials of the first power source signal and the second power source signal that the power source unit 10 outputs, or the size of the power source voltage are determined on the basis of a power source control signal CtrP that is supplied from the CPU 6.

Additionally, in addition to the power source unit 10, the ink jet printer 1 is provided with a DC power source (not shown in the drawings) that is connected to a residential AC electrical outlet or the like. Power is supplied to the main body part from the DC power source.

As shown in FIG. 1, the power transmission unit 2 includes a power transmission circuit 11 that is provided on the outer side (the housing 31 side) of the carriage 32 as a main body part, a power reception circuit 12 that is built into the carriage 32 as a built-in component EB, and a wireless transmission unit 20.

The wireless transmission unit 20 includes a conductor 21 and a conductor 23, which are provided on the outer side (the housing 31 side) of the carriage 32 as main body parts, and a conductor 22 and a conductor 24, which are built into the carriage 32 as built-in components EB. More specifically, as shown in FIG. 4, the conductor 21 is provided on a side that is opposite to the conductor 22 with the transport pathway such as the platen 74 interposed therebetween, and the conductor 23 is provided on a side that is opposite to the conductor 24 with the transport pathway interposed therebetween. In addition, the conductors 21 to 24 are disposed so that, when viewed from an upper side (the +Z direction), at least a part of the conductor 21 and at least a part of the conductor 22 overlap, and at least a part of the conductor 23 and at least a part of the conductor 24 overlap. Additionally, the details of the power transmission unit 2 will be described later.

2. HEAD UNIT

Figure 5:
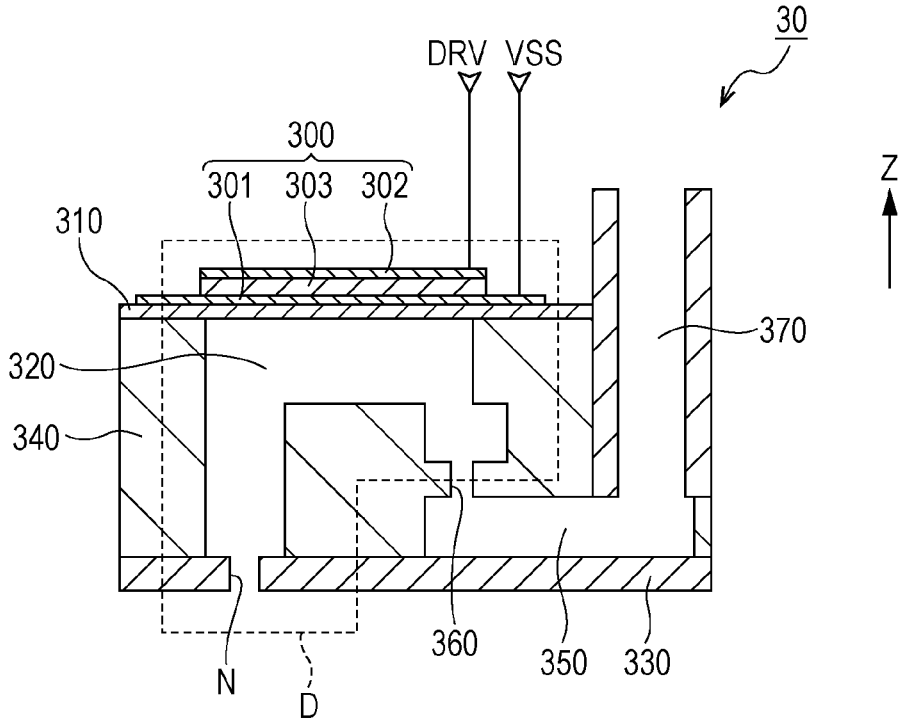
FIG. 5 is a schematic partial cross-sectional view of a head unit.

Next, the head unit 30 and the discharge units D that are provided in the head unit 30 will be described with reference to FIGS. 5 to 7. FIG. 5 is an example of a schematic partial cross-sectional view of the head unit 30. Additionally, in the figure, one discharge unit D of the M discharge units D, a reservoir 350 that is in communication with the discharge unit D through an ink supply opening 360, and an ink intake opening 370 for supplying ink from the ink cartridge 33 to the reservoir 350, of the head unit 30 are shown for the convenience of illustration.

As shown in FIG. 5, the discharge unit D is provided with a piezoelectric element 300, a cavity 320 (a pressure chamber), the inside of which is filled with ink, a nozzle N that is in communication with the cavity 320, and a vibration plate 310. The discharge unit D discharges the ink that is inside the cavity 320 via the nozzle N as a result of the piezoelectric element 300 being driven by the drive signal DRV.

The cavity 320 of the discharge unit D is a space that is partitioned by a cavity plate 340 that is formed in a predetermined shape to have a concave part, a nozzle plate 330 in which the nozzle N is formed, and the vibration plate 310. The cavity 320 is in communication with the reservoir 350 through the ink supply opening 360. The reservoir 350 is in communication with the ink cartridge 33 through the ink intake opening 370.

In the present embodiment, a unimorph (monomorph) type piezoelectric element as shown in FIG. 5 is adopted as the piezoelectric element 300. The piezoelectric element 300 includes a lower part electrode 301, an upper part electrode 302, and a piezoelectric body 303 that is provided between the lower part electrode 301 and the upper part electrode 302. Further, when a voltage is applied between the lower part electrode 301 and the upper part electrode 302 by supplying a standard voltage VSS, which will be described later, to the lower part electrode 301, and supplying the drive signal DRV to the upper part electrode 302, the piezoelectric element 300 is bent in a vertical direction in the drawing in response to the voltage that is applied, and the piezoelectric element 300 vibrates as a result.

The vibration plate 310 is installed in an upper surface aperture part of the cavity plate 340, and the lower part electrode 301 is joined to the vibration plate 310. Therefore, when the piezoelectric element 300 vibrates due to the drive signal DRV, the vibration plate 310 also vibrates. Further, a capacity of the cavity 320 (an internal pressure of the cavity 320) changes due to the vibrations of the vibration plate 310, and ink with which the inside of the cavity 320 is filled is discharged via the nozzle N.

In a case in which amount of ink inside the cavity 320 is reduced due to the discharge of ink, ink is supplied from the reservoir 350. In addition, ink is supplied from the ink cartridge 33 to the reservoir 350 through the ink intake opening 370.

Figure 6:
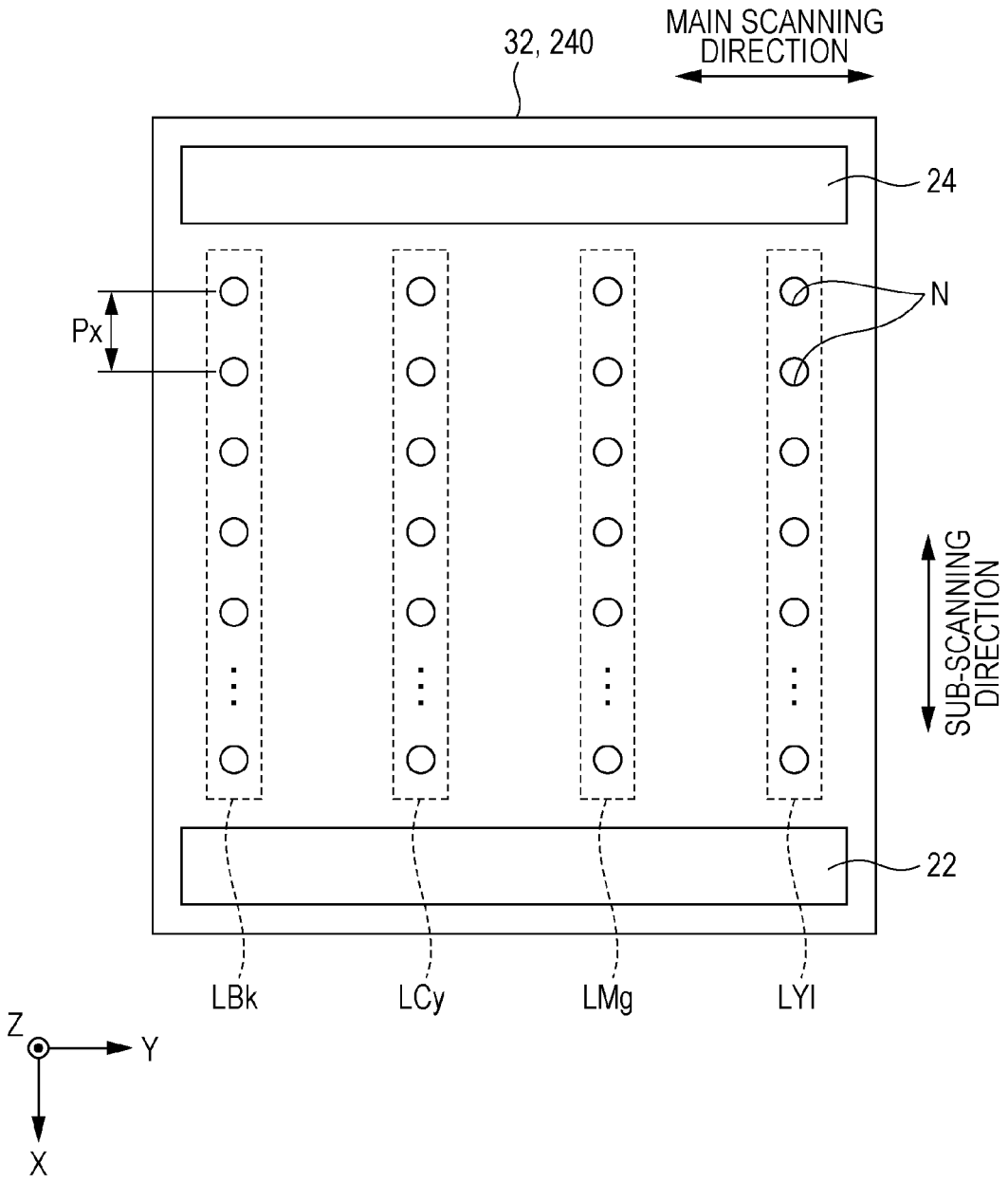
FIG. 6 is a plan view that shows an arrangement of nozzles in the head unit.

FIG. 6 is an explanatory drawing for describing positions of M nozzles N of the head unit 30, and the positions of the conductor 22 and the conductor 24 when the carriage 32 is viewed from the +Z direction or the −Z direction.

The M nozzles N are disposed in a manner in which four nozzle rows are aligned in the head unit 30 that is also provided in the carriage 32. More specifically, as shown in FIG. 6, a nozzle row LBK that is formed from a plurality of nozzles N that respectively correspond to a plurality of discharge units D that discharge black ink, a nozzle row LCy that is formed from a plurality of nozzles N that respectively correspond to a plurality of discharge units D that discharge cyan ink, a nozzle row LMg that is formed from a plurality of nozzles N that respectively correspond to a plurality of discharge units D that discharge magenta ink, and a nozzle row LY1 that is formed from a plurality of nozzles N that respectively correspond to a plurality of discharge units D that discharge yellow ink are provided in the head unit 30. Additionally, a pitch Px between the nozzles N in each nozzle row can be set as appropriate depending on a printing resolution (dpi: dots per inch).

In addition, in the carriage 32, the conductor 22 is provided in the +X direction of the head unit 30 so as to extend in the Y axis direction, and the conductor 24 is provided in the −X direction of the head unit 30 so as to extend in the Y axis direction.

Additionally, as shown in FIG. 6, in the present embodiment, each nozzle row is a nozzle row in which a plurality of nozzles N are aligned in one row in the X axis direction, but the invention is not limited to this kind of nozzle rows, and for example, a configuration that includes nozzle rows that are arranged in a so-called zig-zag shape in which, among a plurality of nozzles N that configure each nozzle row, the positions of even-numbered nozzles N and odd-numbered nozzles N differ in the Y axis direction, may be used.

3. POWER TRANSMISSION UNIT

Next, the power transmission unit 2 will be described with reference to FIGS. 7 and 8.

Figure 7:
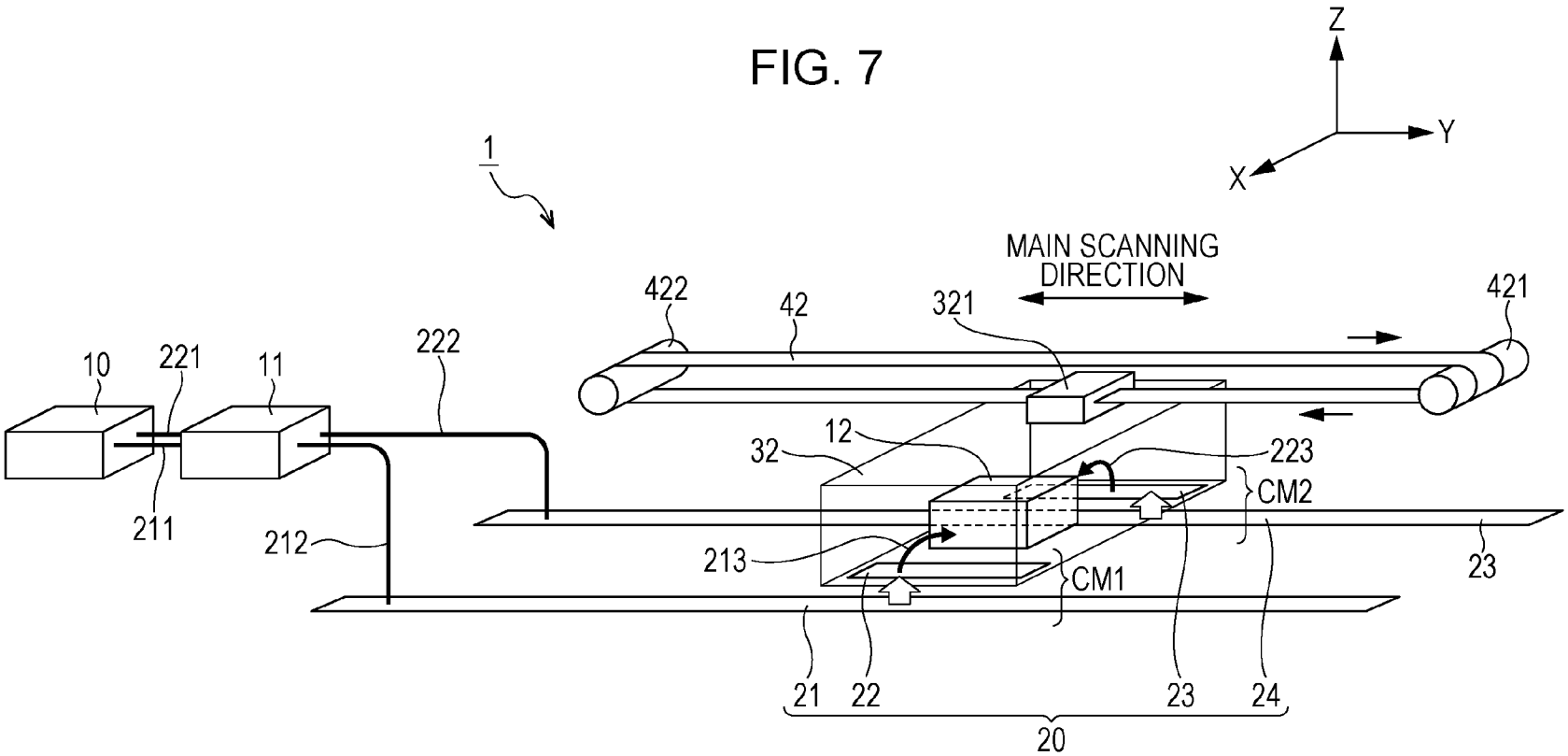
FIG. 7 is an explanatory drawing for describing a power supply pathway and a power discharge pathway of a power transmission unit.

FIG. 7 is an explanatory drawing for describing a power supply pathway and a power discharge pathway of the power transmission unit 2.

As shown in FIG. 7, the power source unit 10 is electrically connected to the power transmission circuit 11 through a power supply pathway 211 and is electrically connected to the power transmission circuit 11 through a power discharge pathway 221. Further, the power source unit 10 applies a power supply voltage to the power transmission circuit 11 by supplying the first power source signal to the power supply pathway 211 and supplying the second power source signal to the power discharge pathway 221.

The power transmission circuit 11 is electrically connected to the conductor 21 through a power supply pathway 212, and is electrically connected to the conductor 23 through a power discharge pathway 222.

As shown in FIG. 7, the conductor 21 extends in the Y axis direction on a lower side (the −Z direction) of the conductor 22 that is provided in the carriage 32 so as to cover a movement range of the conductor 22 in the Y axis direction, which accompanies the reciprocating movement of the carriage 32. Therefore, even in a case in which the carriage 32 performs reciprocating movement in the main scanning direction, the conductor 21 and the conductor 22 can retain a state of mutually facing one another. Accordingly, the conductor 21 and the conductor 22 form a coupling capacitance CM1 through electric field coupling thereof, and a capacitance value of the coupling capacitance CM1 is preserved at a substantially constant value even when the carriage 32 performs reciprocating movement in the main scanning direction. The coupling capacitance CM1 configures a part of the power supply pathway.

In the same manner, the conductor 23 extends in the Y axis direction on a lower side (the −Z direction) of the conductor 24 that is provided in the carriage 32 so as to cover a movement range of the conductor 24 in the Y axis direction, which accompanies the reciprocating movement of the carriage 32. Therefore, the conductor 23 and the conductor 24 form a coupling capacitance CM2 through electric field coupling thereof, and a capacitance value of the coupling capacitance CM2 is preserved at a substantially constant value even when the carriage 32 performs reciprocating movement in the main scanning direction. The coupling capacitance CM2 configures a part of the power supply pathway.

The conductor 22 is electrically connected to the power reception circuit 12 through a power supply pathway 213, and the conductor 24 is electrically connected to the power reception circuit 12 through a power discharge pathway 223. Further, the power reception circuit 12 is electrically connected to the head unit 5 through a power discharge pathway 224 in addition to being electrically connected to the head unit 5 through a power supply pathway 214 (refer to FIG. 8).

In this manner, in the present embodiment, the power supply pathway is formed by the power supply pathways 211 to 214 and the coupling capacitance CM1, and the power discharge pathway is formed by the power discharge pathways 221 to 224 and the coupling capacitance CM2. That is, a part of the power supply pathway is configured by the coupling capacitance CM1, and a part of the power discharge pathway is configured by the coupling capacitance CM2. Therefore, it is possible to perform the delivery of power from the power source unit 10 to the built-in components EB such as the head unit 5 that are built into the carriage 32 without contact (wirelessly).

Additionally, the conductor 21 and the conductor 23 are respectively examples of a "first conductor", and the conductor 22 and the conductor 24 are respectively examples of a "second conductor" that faces the first conductor. That is, the wireless transmission unit 20 delivers at least a part of the power that is supplied from the power source unit 10 to the built-in components EB such as the head unit 5 through coupling capacitances that are formed by the first conductor and the second conductor.

Therefore, in the ink jet printer 1 according to the present embodiment, it is possible to deliver power from the power source unit 10 that is provided in on the outer side (the housing 31 side) of the carriage 32 as a main body part to the head unit 5 that is built into the carriage 32 as a built-in component EB without using physical wiring such as an FFC.

In the abovementioned manner, in ink jet printers of the related art, power is delivered from a power source on a housing side to a head unit that is built into a carriage using physical wiring such as an FFC. In this kind of ink jet printer of the related art, in a case in which the carriage performs reciprocating movement in the main scanning direction, there were circumstances in which an FFC became a physical obstruction. In addition, in the ink jet printers of the related art, there were circumstances in which noise that is generated as a result of an FFC moving in accordance with reciprocating movement of the carriage spreads to a control signal that is transmitted to the head unit.

These kinds of defects that result from the presence of an FFC is a cause of breakdowns in ink jet printers, and is a cause of the deterioration of the image quality of images that ink jet printers print.

In contrast to this, in the ink jet printer 1 according to the present embodiment, it is possible to deliver power without the use of an FFC. As a result of this, it is possible to eliminate various defects that are related to FFCs, and therefore, it is possible to improve the quality of printing in comparison with ink jet printers of the related art that transmit power to a head unit using an FFC, and it is possible to reduce a frequency of breakdowns in the ink jet printer 1.

Figure 8:
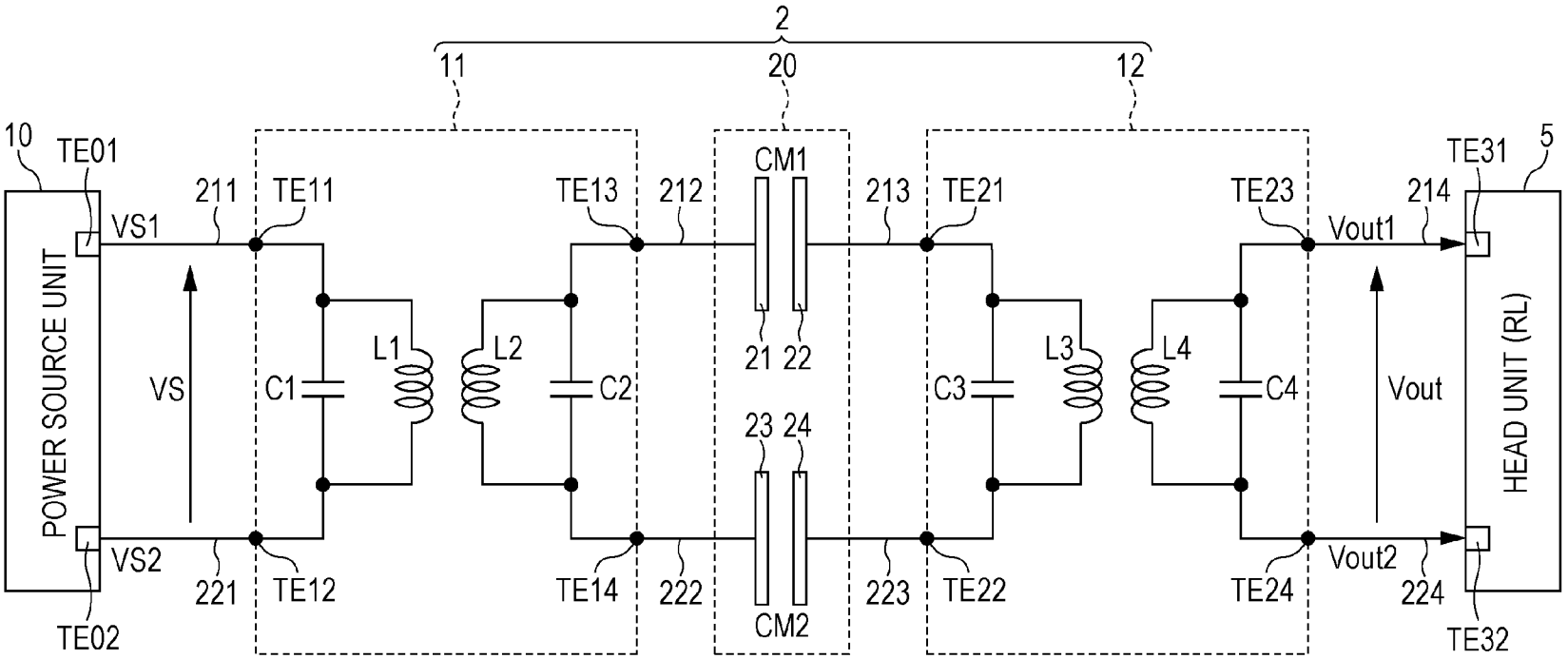
FIG. 8 is a circuit diagram of the power transmission unit.

FIG. 8 is an example of an equivalent circuit diagram of the power transmission unit 2.

As shown in the figure, the power source unit 10 applies a power source voltage VS, which is a difference in potential between a potential that of a first power source signal VS1 and a potential of a second power source signal VS2, between a terminal TE11 and a terminal TE12 of the power transmission circuit 11 by outputting the first power source signal VS1 from a terminal TE01 to the power supply pathway 211 and outputting the second power source signal VS2 from a terminal TE02 to the power supply pathway 212.

As shown in FIG. 8, the power transmission circuit 11 is provided with a capacitance C1 that is provided between the terminal TE11 and the terminal TE12, an inductor L1 that is connected to the capacitance C1 in parallel, a capacitance C2 that is provided between a terminal TE13 and a terminal TE14, and an inductor L2 that is connected to the capacitance C2 in parallel. The inductor L1 and the inductor L2 are electromagnetically coupled, a magnetic field is generated by electromagnetic induction when the size of a current that flows through the inductor L1 changes, and an induced electromotive force is generated in the inductor L2 by this magnetic field. The inductor L1 and the inductor L2 function as transformers.

As shown in FIG. 8, the terminal TE13 of the power transmission circuit 11 is electrically connected to the conductor 21, which is a first electrode of the coupling capacitance CM1, through the power supply pathway 212, and the terminal TE14 of the power transmission circuit 11 is electrically connected to the conductor 23, which is a first electrode of the coupling capacitance CM2, through the power discharge pathway 222.

The conductor 22, which is a second electrode of the coupling capacitance CM1, is electrically connected to a terminal TE21 of the power reception circuit 12 through the power supply pathway 213. In addition, the conductor 24, which is a second electrode of the coupling capacitance CM2, is electrically connected to a terminal TE22 of the power reception circuit 12 through the power discharge pathway 223.

As shown in FIG. 8, the power reception circuit 12 is provided with a capacitance C3 that is provided between the terminal TE21 and the terminal TE22, an inductor L3 that is connected to the capacitance C3 in parallel, a capacitance C4 that is provided between a terminal TE23 and a terminal TE24, and an inductor L4 that is connected to the capacitance C4 in parallel. The inductor L3 and the inductor L4 are electromagnetically coupled, a magnetic field is generated by electromagnetic induction when the size of a current that flows through the inductor L3 changes, and an induced electromotive force is generated in the inductor L4 by this magnetic field. The inductor L3 and the inductor L4 function as transformers.

The power reception circuit 12 applies an output voltage Vout, which is a difference in potential between a potential of a first output signal Vout1 and a potential of a second output signal Vout2, between a terminal TE31 and a terminal TE32 of the head unit 5 by outputting the first output signal Vout1 from the terminal TE23 to the power supply pathway 214 and outputting the second output signal Vout2 from the terminal TE24 to the power discharge pathway 224.

Additionally, in the present embodiment, the respectively inductances of the inductor L2 and the inductor L3, and the respectively capacitance values of the capacitance C2 and the capacitance C3 are determined so that a resonance frequency of an LC circuit that is configured by the inductor L2 and the capacitance C2 and a resonance frequency of an LC circuit that is configured by the inductor L3 and the capacitance C3 become substantially the same. In this case, it is possible to increase a delivery efficiency of power in the power transmission unit 2.

4. DELIVERY EFFICIENCY OF POWER TRANSMISSION UNIT

Next, the delivery efficiency of power by the power transmission unit 2 will be described with reference to FIGS. 9 to 13.

Figure 9:
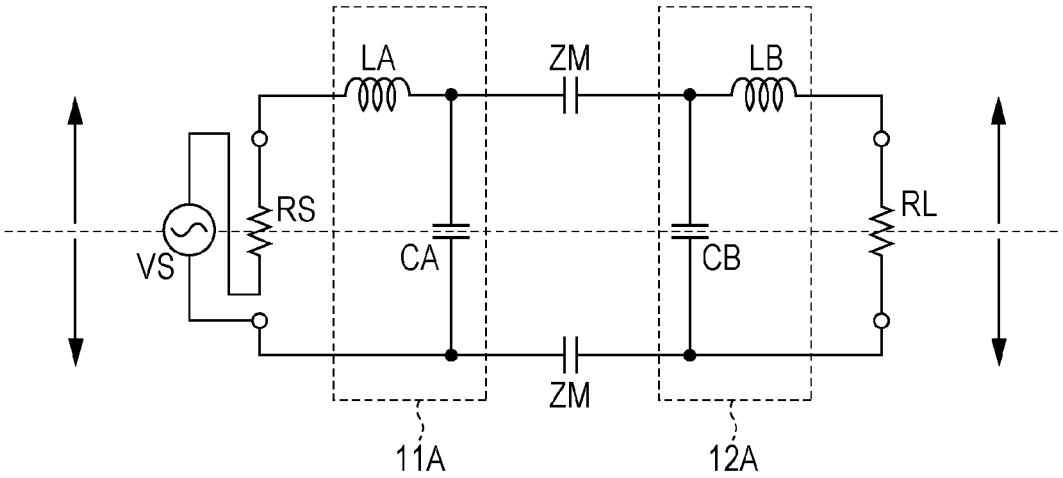
FIG. 9 is an explanatory drawing for describing an operation of the power transmission unit.

Additionally, in FIG. 9, an internal resistance of the power source unit 10 that is shown in FIG. 8 is represented by resistance RS, and an electrical resistance between the terminal TE31 and the terminal TE32 of the head unit 5 is represented by resistance RL.

In addition, in FIG. 9, the power transmission circuit 11 is represented by an equivalent circuit 11A, which has an inductor with an inductance LA and a capacitance with a capacitance value CA, and which is a circuit that is equivalent to the power transmission circuit 11, and the power reception circuit 12 is represented by an equivalent circuit 12A, which has an inductor with an inductance LB and a capacitance with a capacitance value CB, and which is a circuit that is equivalent to the power reception circuit 12.

Furthermore, in FIG. 9, it is assumed that the capacitance values of the coupling capacitance CM1 and the coupling capacitance CM2 that are shown in FIG. 8 are equal, and an impedance of the coupling capacitance CM1 and the coupling capacitance CM2 is represented by an impedance ZM.

Figure 10:
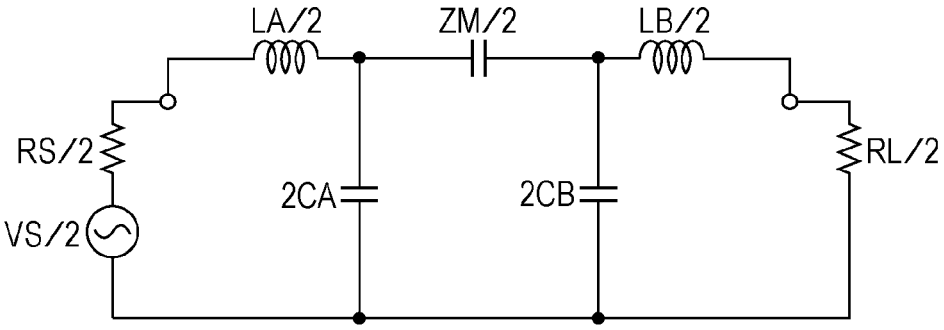
FIG. 10 is an explanatory drawing for describing an operation of the power transmission unit.

FIG. 10 illustrates a circuit in which the circuit that is shown in FIG. 9 is split into two circuits of an upper side and a lower side with a central potential VC of a potential of the first power source signal VS1 and a potential of the second power source signal VS2 that the power source unit 10 generates set as a standard.

In this instance, for the convenience of calculation, each value in the circuit that is shown in FIG. 10 can be substituted in the following manner.

$$RS/2=RL/2=z0 \quad \text{Formula (1)}$$

$$LA/2=LB/2=L \quad \text{Formula (2)}$$

$$2CA=2CB=C \quad \text{Formula (3)}$$

$$ZM=R \quad \text{Formula (4)}$$

Figure 11:
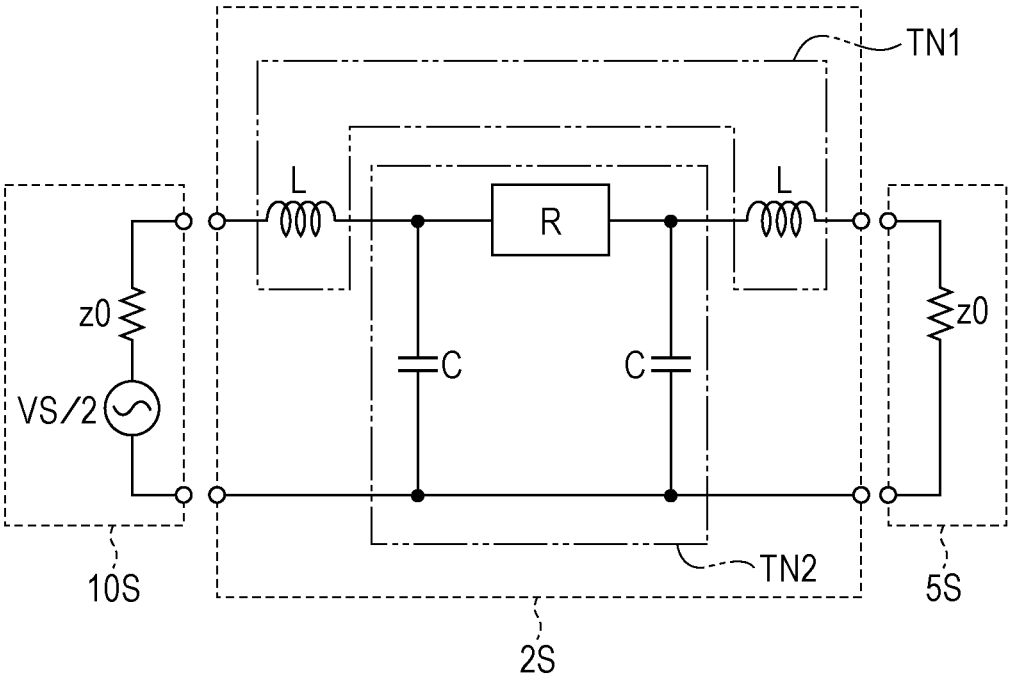
FIG. 11 is an explanatory drawing for describing an operation of the power transmission unit.

In this case, the circuit that is shown in FIG. 10 can be represented by the circuit that is shown in FIG. 11 which is equivalent thereto.

In FIG. 11, a circuit 10S corresponds to one of two circuits into which the power source unit 10 is split with the central potential VC as a standard thereof, a circuit (a two-terminal pair circuit) 2S corresponds to one of the power supply pathway or the power discharge pathway of the power transmission unit 2, and a circuit 5S corresponds to one of two resistances in which the resistance RL between the terminal TE31 and the terminal TE32 of the head unit 5 has been split with the central potential VC as a standard thereof.

Hereinafter, a voltage transmission coefficient and a power transmission coefficient of the two-terminal pair circuit 2S will be obtained as a value that shows the delivery efficiency of power by the two-terminal pair circuit 2S.

In this instance, the voltage transmission coefficient is a value that represents a ratio of a voltage that is output from an output terminal with respect to a voltage that is applied to an input terminal of the two-terminal pair circuit (a voltage gain). In addition, the power transmission coefficient is a value that represents a ratio of a power that is output from the output terminal with respect to a power that is supplied to the input terminal of the two-terminal pair circuit (a power gain).

Among a two-by-two scattering matrix that shows conveyance characteristics of the two-terminal pair circuit, the voltage transmission coefficient of the two-terminal pair circuit is represented by a component of a second line and a first row. In addition, the power transmission coefficient of the two-terminal pair circuit is represented by the square of an absolute value of a component of a second line and a first row of the scattering matrix. These the scattering matrix of the two-terminal pair circuit necessary for determining the voltage transmission coefficient and the power transmission coefficient, can be obtained from an impedance matrix of the two-terminal pair circuit.

In such an instance, in the following, firstly, an impedance matrix Z of the two-terminal pair circuit 2S is calculated, and the voltage transmission coefficient and the power transmission coefficient of the two-terminal pair circuit 2S are subsequently obtained by calculating a scattering matrix S of the two-terminal pair circuit 2S.

The two-terminal pair circuit 2S is formed from a two-terminal pair circuit TN1 and a two-terminal pair circuit TN2. More specifically, as shown in FIG. 12, the two-terminal pair circuit 2S shown in FIG. 11 is a circuit in which the two-terminal pair circuit TN1 and the two-terminal pair circuit TN2 are connected in series.

Further, when an impedance matrix of the two-terminal pair circuit TN1 is set as Z1, and an impedance matrix of the two-terminal pair circuit TN2 is set as Z2, the impedance matrix Z of the two-terminal pair circuit 2S can be determined on the basis of Formula (5) below.

$$Z=Z1+Z2 \qquad \text{Formula (5)}$$

Figure 12:
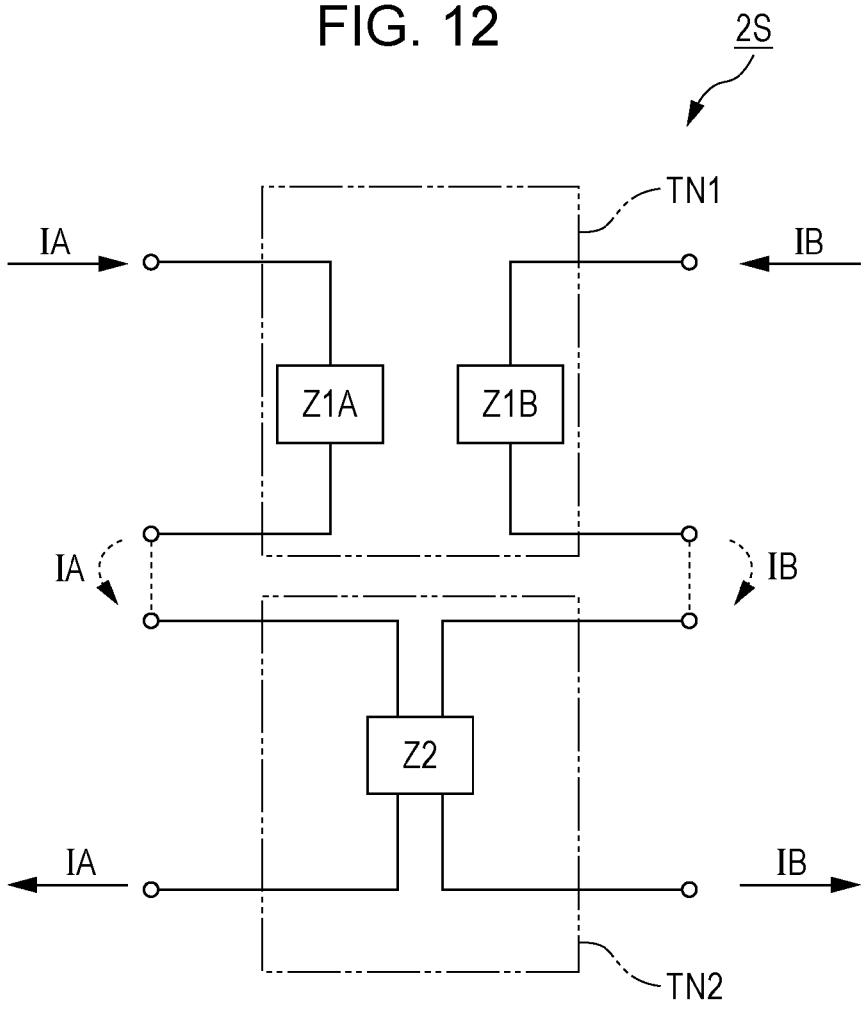
FIG. 12 is an explanatory drawing for describing an operation of the power transmission unit.

The impedance matrix Z1 of the two-terminal pair circuit TN1 that is shown in FIG. 12 is represented by Formula (6) below using an impedance Z1A and an impedance Z1B.

$$Z_1=\begin{bmatrix} Z_{1A} & 0 \\ 0 & Z_{1B} \end{bmatrix} \qquad \text{Formula (6)}$$

The impedance Z1A and the impedance Z1B are impedances that are respectively related to the inductances L. Accordingly, the impedance Z1A and the impedance Z1B can be represented by Formula (7) below using an imaginary unit j, and an angular frequency co of the power source voltage VS.

$$Z1A=Z1B=j\omega L \qquad \text{Formula (7)}$$

That is, it is possible to represent the impedance matrix Z1 with Formula (8) below by substituting Formula (7) into Formula (6).

$$Z_1=\begin{bmatrix} j\omega L & 0 \\ 0 & j\omega L \end{bmatrix} \qquad \text{Formula (8)}$$

Next, the impedance matrix Z2 of the two-terminal pair circuit TN2 is obtained as an inverse matrix of an admittance Y2 of the two-terminal pair circuit TN2.

Figure 13:
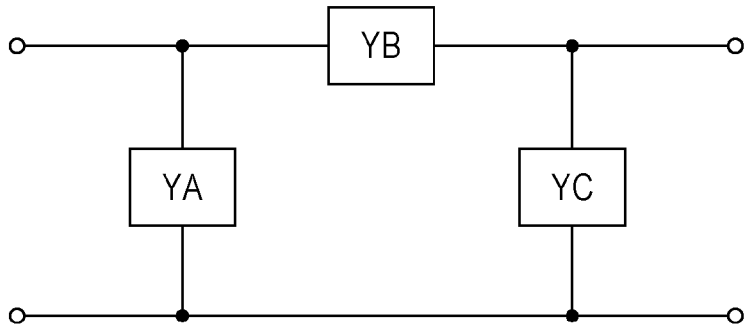
FIG. 13 is an explanatory drawing for describing an operation of the power transmission unit.

An admittance matrix Y of a two-terminal pair circuit that is provided with admittances YA, YB and YC, which are shown in FIG. 13, is represented by Formula (9) below.

$$Y=\begin{bmatrix} Y_A+Y_B & -Y_B \\ -Y_B & Y_B+Y_C \end{bmatrix} \qquad \text{Formula (9)}$$

An admittance of a capacitance C, which is a component of the two-terminal pair circuit TN2, and which is shown in FIG. 11 corresponds to the admittances YA and YC of the two-terminal pair circuit that is shown in FIG. 13, and is represented by Formula (10) below.

$$YA=YC=j\omega C \qquad \text{Formula (10)}$$

In the same manner, an admittance of a resistance R, which is a component of the two-terminal pair circuit TN2, corresponds to the admittance YB of the two-terminal pair circuit that is shown in FIG. 13, and is represented by Formula (11) below.

$$YB=1/R \qquad \text{Formula (11)}$$

Accordingly, the admittance matrix Y2 of the two-terminal pair circuit TN2 can be represented by Formula (12) in which Formula (10) and Formula (11) have been substituted into Formula (9).

$$Y_2=\frac{1}{R}\begin{bmatrix} 1+j\omega CR & -1 \\ -1 & 1+j\omega CR \end{bmatrix} \qquad \text{Formula (12)}$$

The impedance matrix Z2 of the two-terminal pair circuit TN2 can be obtained as an inverse matrix of an admittance matrix Y2 that is shown in Formula (12). Therefore, the impedance matrix Z of the two-terminal pair circuit 2S is obtained as Formula (13) below.

$$Z=j\omega L\begin{bmatrix} 1 & 0 \\ 0 & 1 \end{bmatrix}+Y_2^{-1} \qquad \text{Formula (13)}$$

The scattering matrix S is generally represented by Formula (14) below using the impedance matrix Z and a two-by-two unit matrix I.

$$S=\frac{Z-z_0 I}{Z+z_0 I} \qquad \text{Formula (14)}$$

In addition, in the present embodiment, in order to perform power delivery with high efficiency using an LC resonance phenomenon in the abovementioned manner, the inductance L that is shown in Formula (2), and the capacitance value C that is shown in Formula (3) are obtained so as to satisfy resonance conditions that are shown in Formula (15) below.

Accordingly, among each component of the scattering matrix S that is represented by Formula (16), it is possible to obtain a component s21 of a second line and a first row using Formula (12) to Formula (15). The component s21 is a value that represents the voltage transmission coefficient of the two-terminal pair circuit 2S, and is represented by Formula (17) below.

$$S = \begin{bmatrix} s_{11} & s_{12} \\ s_{21} & s_{22} \end{bmatrix} \quad \text{Formula (16)}$$

$$s_{21} = \frac{2}{2j\omega C z_0 - 2 - \omega^2 C^2 R z_0} \quad \text{Formula (17)}$$

In addition, as described above, the power transmission coefficient of the two-terminal pair circuit 2S is the square $|s21|^2$ of an absolute value of the component s21, and is represented by Formula (18) below.

$$|s_{21}|^2 = \frac{4}{\left(\frac{2z_0}{\omega L}\right)^2 + 4 + \frac{4Rz_0}{\omega^2 L^2} + \left(\frac{Rz_0}{\omega^2 L^2}\right)^2} \quad \text{Formula (18)}$$

In the present embodiment, in order to make the voltage transmission coefficient and the power transmission coefficient larger, each constituent element of the power source unit 10, the power transmission unit 2 and the head unit 5 is designed so that Formula (19) below is established.

$$Z0 \ll R \ll \omega L \quad \text{Formula (19)}$$

In a case in which Formula (19) being established is a prerequisite, the value $|s21|^2$ that is shown in Formula (18) is approximated to a value that is shown in Formula (20) below. In this case, the value $|s21|^2$ of the power transmission coefficient becomes a value that is substantially close to "1", and the power transmission unit 2 has a high delivery efficiency.

$$|s_{21}|^2 \approx 1 - \frac{Rz_0}{\omega^2 L^2} \quad \text{Formula (20)}$$

Hereinafter, conditions that are necessary in order to satisfy the abovementioned Formula (19) will be considered.

Firstly, the "z0<<R" in Formula (19) will be considered.

Generally, the resistance RS of the power source unit 10 that corresponds to an impedance z0 can be set to a small value. In addition, generally, the impedance ZM that is related to the coupling capacitances CM1 and CM2 becomes a larger value. Accordingly, generally, a condition of "z0<<R" is satisfied.

Next, the "R<<ωL" in Formula (19) will be considered.

In a case in which the capacitance value of the coupling capacitance CM1 and the coupling capacitance CM2 are set as CM, an impedance R (the impedance ZM) is represented by Formula (21) below using a capacitance value CM.

$$R = \frac{1}{j\omega C_M} \quad \text{Formula (21)}$$

Formula (22) below can be obtained using Formula (15) and Formula (21). In addition, Formula (23) below can be obtained using Formula (20) and Formula (22).

$$\frac{R}{\omega L} = \frac{C}{C_M}, \quad \text{Formula (22)}$$

$$|s_{21}|^2 \approx 1 - \frac{C}{C_M}\frac{z_0}{\omega L} \quad \text{Formula (23)}$$

As is evident from Formula (22), in order to satisfy the condition of "R<<ωL", the capacitance value CM of the coupling capacitance CM1 and the coupling capacitance CM2 may be determined so as to be sufficiently larger than the capacitance value CA of a capacitance of the power transmission circuit 11 and a capacitance value CB of a capacitance of the power reception circuit 12.

In this case, as shown in Formula (23), the value $|s21|^2$ of the power transmission coefficient becomes a value that is substantially close to "1".

5. RELATIONSHIP BETWEEN RECORDING MEDIUM AND SUPPLY POWER

Next, a relationship between the recording medium P and the power that the power transmission unit 2 supplies will be described with reference to FIGS. 14 to 16.

Figure 14:
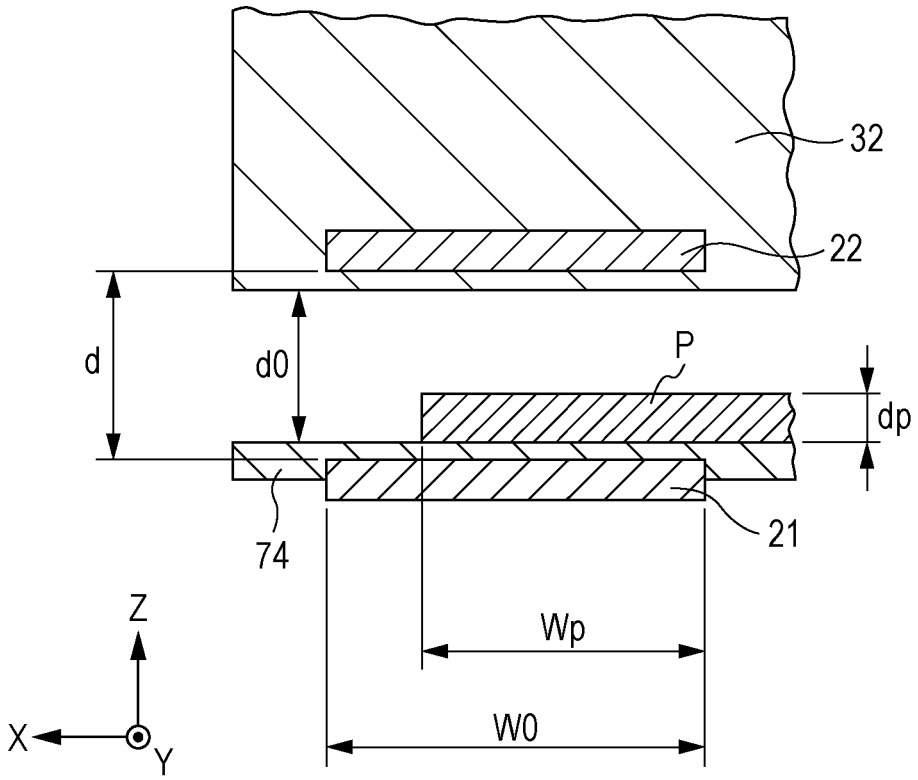
FIG. 14 is an explanatory drawing for describing a relationship between the power transmission unit and a recording medium.

FIG. 14 is an explanatory drawing for describing a relationship between the capacitance value CM of the coupling capacitance CM1 and the coupling capacitance CM2 and the recording medium P. Additionally, in FIG. 14, description is made using the coupling capacitance CM1 (the conductor 21 and the conductor 22) as an example, but the following description also applies to the coupling capacitance CM2 (the conductor 23 and the conductor 24).

As shown in FIG. 14, an area in which the conductor 21 and the conductor 22 mutually overlap when viewed in either the +Z direction or the −Z direction is set as "W0". In addition, an interval (in Z axis direction) between the conductor 21 and the conductor 22 is set as "d". In addition, a dielectric constant of a material that is between the conductor 21 and the conductor 22 is set as "∈". At this time, the capacitance value CM of the coupling capacitance CM1 is represented by Formula (24) below.

$$CM = \in * W0/d \quad \text{Formula (24)}$$

That is, the capacitance value CM increase in accordance with increases in size of the dielectric constant ∈, increases in the size of the area W0 or decreases in the size of the interval d, and the voltage transmission coefficient and the power transmission coefficient also increase.

A specific dielectric constant of air is "1.00059", and is substantially equivalent to "1". In addition, generally, the specific dielectric constants of materials other than air are greater than "1". Therefore, the larger a ratio of the thickness dp of the recording medium P with respect to an interval d0 between the carriage 32 and the platen 74, the larger the capacitance value CM, and the larger the dielectric constant ∈ of the recording medium P, the larger the capacitance value CM.

In addition, an area of a portion in which the recording medium P, the conductor 21 and the conductor 22 mutually overlap when viewed in either the +Z direction or the −Z direction is set as "Wp". At this time, the larger a ratio of the area Wp with respect to the area W0, the larger the capacitance value CM.

In a case in which the size of the power source voltage VS is determined as a constant value with the fact that the capacitance value CM is a predetermined value (a standard capacitance value CM0) as a prerequisite, there are cases in which the capacitance value CM becomes a value that is larger than the standard capacitance value CM0, and cases in which the capacitance value CM becomes a value that is smaller than the standard capacitance value CM0.

In a case in which the capacitance value CM becomes a value that is larger than the standard capacitance value CM0, surplus power is supplied from the power source unit 10, and furthermore, output voltage Vout that is larger than necessary voltage is applied to the head unit 5. In this case, the power consumption of the ink jet printer 1 is increased, and furthermore, the abovementioned factors can also become causes of breakdowns in the circuits of the head unit 5.

In contrast to this, in a case in which the capacitance value CM becomes a value that is smaller than the standard capacitance value CM0, since the power that the head unit 5 requires is not supplied from the power source unit 10, this can become a cause of deteriorations in printing quality.

In such an instance, the ink jet printer 1 according to the present embodiment changes the power that the power source unit 10 supplies to the power transmission unit 2 depending on the type of the recording medium P and the position of the recording medium P. In this instance, the type of the recording medium P is a factor that classifies recording mediums P in which at least one of a thickness dp of the recording medium P and a dielectric constant ∈ (a specific dielectric constant ∈r) of the recording medium P differ.

Additionally, the ink jet printer 1 may be an ink jet printer that changes the power that the power source unit 10 supplies to the power transmission unit 2 on the basis of at least one of the type of the recording medium P and the position of the recording medium P.

FIG. 15 is an explanatory drawing that shows an example of a data configuration of the recording medium information table TBL.

In this manner, the recording medium information table TBL stores the type of the recording medium P that the ink jet printer 1 sets as a printing target thereof, the size of the power source voltage VS that should be applied to the power transmission unit 2 from the power source unit 10 when a printing process is executed on each recording medium P, the size of the supply power Ws that is supplied to the power transmission unit 2 from the power source unit 10 when a printing process is executed on each recording medium P, the thickness dp of each recording medium P, and the specific dielectric constant ∈r of the recording medium P in association with one another.

Additionally, as long as the recording medium information table TBL stores the type of the recording medium P and at least one of the size of the supply power Ws and the size of the power source voltage VS in association with one another, the recording medium information table TBL need not necessarily store the thickness dp of the recording medium P or the specific dielectric constant ∈r of the recording medium P.

When the printing data PD and the recording medium data MD are supplied from the host computer 9, and a printing process is initiated, the CPU 6 refers to the recording medium information table TBL, and acquires values of the power source voltage VS and the supply power Ws that correspond to the recording medium P that is shown in the recording medium data MD. Further, the CPU 6 creates the power source control signal CtrP that selects the supply power Ws and the power source voltage VS that the power source unit 10 should output to the power transmission unit 2 on the basis of the acquired values, and outputs the power source control signal CtrP to the power source unit 10. As a result of this, the power source unit 10 can output a supply power Ws and a power source voltage VS that are appropriate depending on the type of the recording medium P to the power transmission unit 2.

The values of the supply power Ws and the power source voltage VS that are stored in the recording medium information table TBL are established so as to decrease with increases in the dielectric constant ∈ of the recording medium P, and to decrease with increases in the thickness dp of the recording medium P.

In the abovementioned manner, the voltage transmission coefficient and the power transmission coefficient increase with increases in the dielectric constant ∈ of the recording medium P, and in addition, the voltage transmission coefficient and the power transmission coefficient increase with increases in the thickness dp of the recording medium P. Therefore, in the present embodiment, as shown in FIG. 15, by setting the values of the supply power Ws and the power source voltage VS to be small in a case in which a printing process is executed on a recording medium P with a high dielectric constant ∈ in comparison with a case in which a printing process is executed on a recording medium P with a low dielectric constant ∈, and in addition, setting the values of the supply power Ws and the power source voltage VS to be small in a case in which a printing process is executed on a recording medium P with a high thickness dp in comparison with a case in which a printing process is executed on a recording medium P with a low thickness dp, it is possible to prevent a circumstance in which there is an excess or a deficiency in the supply power Ws and the power source voltage VS power that are supplied.

In addition, the CPU 6 calculates the area Wp in which the recording medium P and the coupling capacitance CM1 (the coupling capacitance CM2) overlap on the basis of the position of the recording medium P that is calculated on the basis of a detection result of the detector group 83. Further, the CPU 6 controls the size of the supply power Ws and the power source voltage VS depending on the area Wp by creating the power source control signal CtrP that shows a value that depends on the calculated area Wp.

In this case, the power source unit 10 can output an appropriate supply power Ws and power source voltage VS that take a transport position of the recording medium P into account.

Additionally, in the present embodiment, the CPU 6 determines the values of the supply power Ws and the power source voltage VS on the basis of the dielectric constant ∈ of the recording medium P, the thickness dp of the recording medium P and the position of the recording medium P, but the invention is not limited to this kind of aspect and the CPU 6 may determine the values of the supply power Ws and the power source voltage VS on the basis of at least one of the dielectric constant ∈, the thickness dp, and the position of the recording medium P.

In the present embodiment, photographic paper, normal paper, and a synthetic resin medium are included in the recording medium P that the ink jet printer 1 sets as a printing target thereof.

Figure 16A:
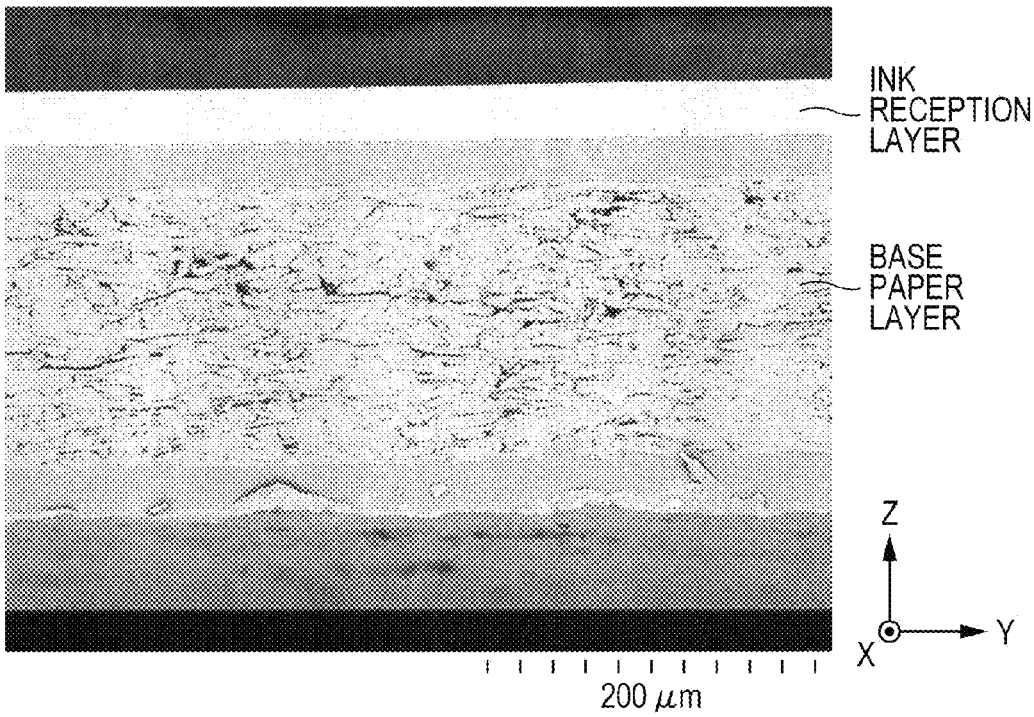
FIGS. 16A and 16B are photomicrographs obtained by imaging cross-sections of recording media have been imaged.

In this instance, photographic paper is a general term for a paper medium such as photopaper, glossy photopaper, matte photopaper, coated paper, glossy photographic paper, and matte photographic paper. FIG. 16A is a cross-sectional photograph of a coated paper, which is an example of photographic paper. As is exemplified in the figure, the photographic paper is provided with a base paper layer that is formed from cellulose fibers or the like, and an ink reception layer that is formed from synthetic silica or the like that is provided on a display surface side of the base paper layer.

Figure 16B:
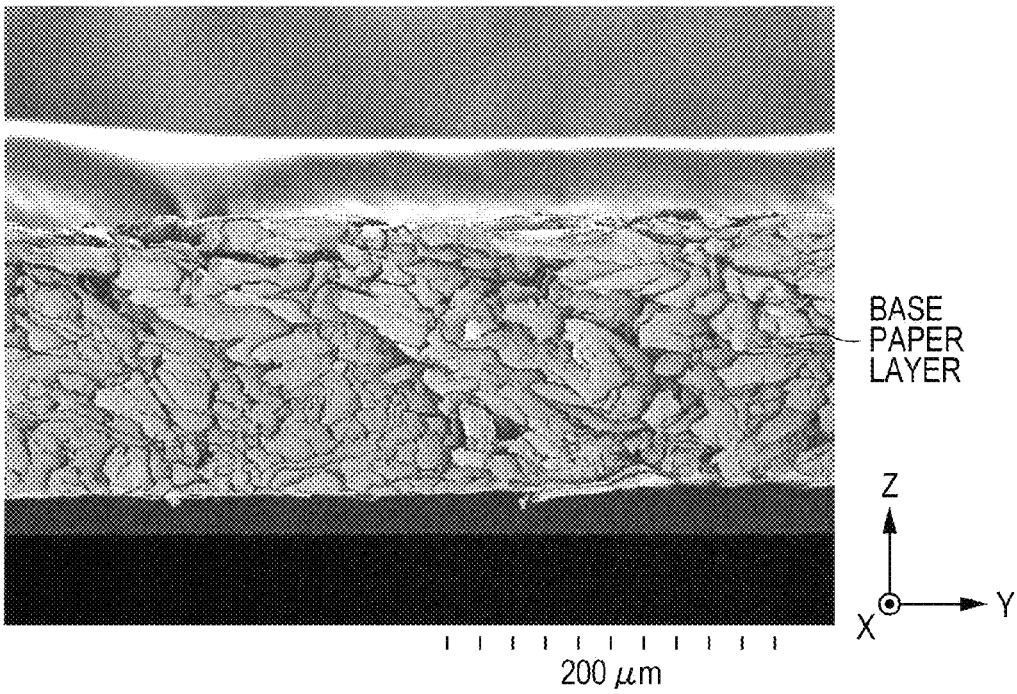

Normal paper is a general term for a paper medium such as standard paper, recycled paper, and fine paper. FIG. 16B shows a cross-sectional photograph of standard paper, which is an example of normal paper. As is exemplified in this figure, the standard paper is provided with a base paper layer that is formed from cellulose fibers or the like, but does not have the ink reception layer in the manner of the photographic paper.

In this manner, the photographic paper has the ink reception layer in addition to the base paper layer. Therefore, the thickness dp of the photographic paper is thicker than that of the normal paper which does not have the ink reception layer. In addition, there are many cases in which the specific dielectric constant $\in r$ (the dielectric constant $\in$) of the ink reception layer is high in comparison with the base paper layer. Therefore, the dielectric constant $\in$ of the photographic paper is higher than that of the standard paper.

In the present embodiment, the supply power Ws and the power source voltage VS are smaller in a case in which a printing process is executed on the photographic paper in comparison with a case in which a printing process is executed on the standard paper. As a result of this, it is possible to prevent a circumstance in which there is an excess or a deficiency in the supply power Ws and the power source voltage VS power that are supplied.

The synthetic resin medium is a general term for a paper medium P that is configured to include a synthetic resin such as a recording medium P that is configured to include polyethylene terephthalate such as an OHP sheet, a recording medium P that is configured to include vinyl chloride or the like.

The specific dielectric constant $\in r$ (the dielectric constant $\in$) of the synthetic resin medium is higher than that of the standard paper. In such an instance, in the manner of the present embodiment, the supply power Ws and the power source voltage VS are smaller in a case in which a printing process is executed on the synthetic resin medium in comparison with a case in which a printing process is executed on the standard paper. As a result of this, it is possible to prevent a circumstance in which there is an excess or a deficiency in the supply power Ws and the power source voltage VS power that are supplied.

6. HEAD DRIVE CIRCUIT 50

The configuration and operation of the head unit 5 will be described with reference to FIGS. 17 and 18.

Figure 17:
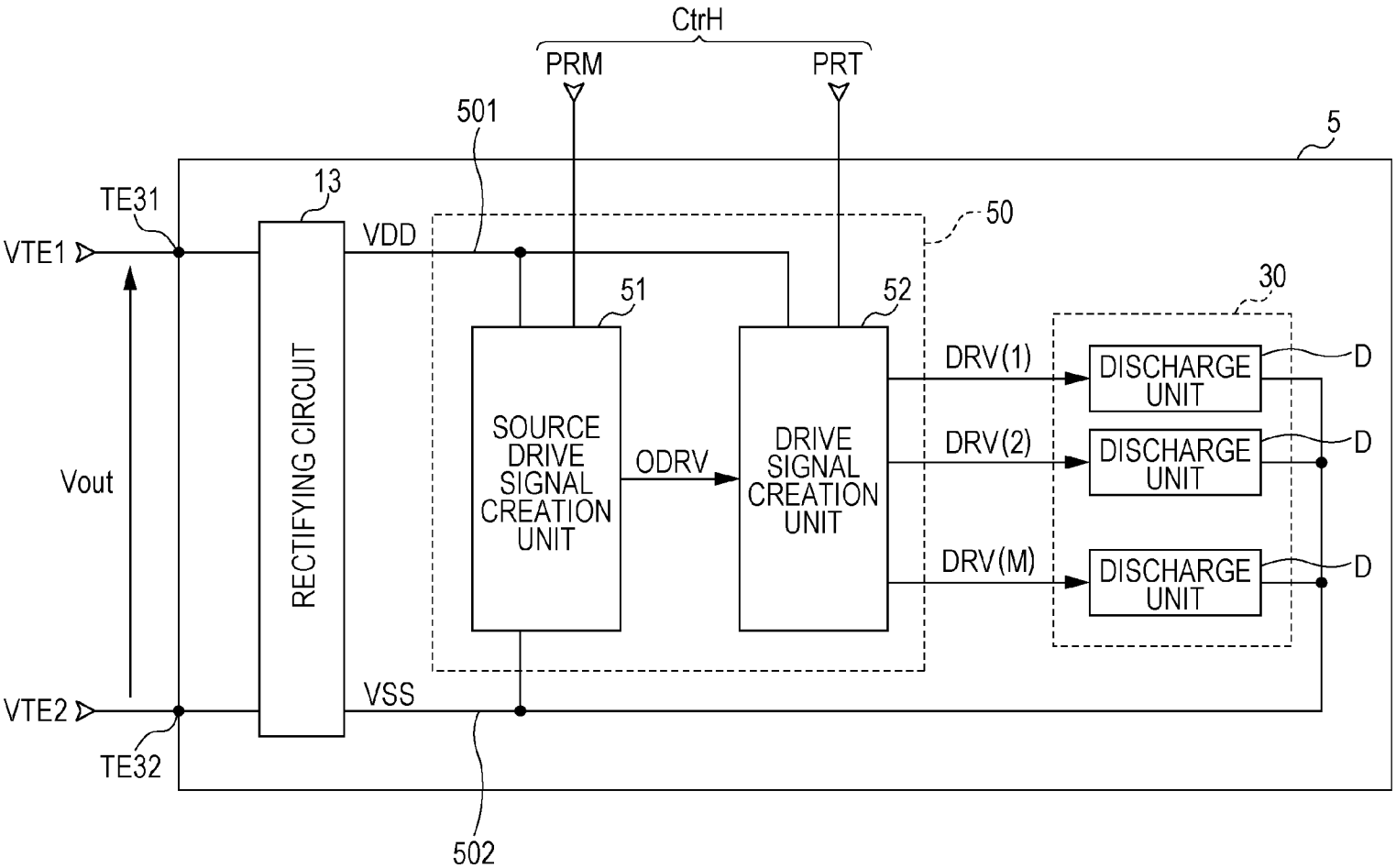
FIG. 17 is a block diagram that shows a configuration of a head unit.

FIG. 17 is an example of an equivalent circuit diagram of the head unit 5. As shown in the figure, the head unit 5 is provided with an adjustment circuit 13, the head drive circuit 50, and the head unit 30.

The adjustment circuit 13 is for example, an AC-DC converter, and converts the output voltage Vout, which is an AC voltage that is supplied from the power transmission unit 2 into a DC voltage. More specifically, the adjustment circuit 13 sets a potential of a power source line 501, which is a power supply pathway, to a constant potential VDD on a high potential side, and sets a potential of a power source line 502, which is a power discharge pathway, to a standard voltage VSS that is lower than the potential VDD.

The head drive circuit 50 includes a source drive signal creation unit 51 and a drive signal creation unit 52. The head drive circuit 50 respectively supplies the drive signal DRV to the M discharge units D. Additionally, in FIG. 17 and FIG. 18, numerals that are inside brackets that are added to the ends of each signal name show a number of the discharge unit D to which the corresponding signal is supplied.

Additionally, the head unit 5 may have four head drive circuits 50 to correspond one-on-one to the four nozzle rows, or may have one common head drive circuit 50 that is shared by the M discharge units D.

The source drive signal creation unit 51 creates the source drive signal ODRV on the basis of parameters for source drive signal creation PRM that are included in the control signal CtrH that is supplied from the CPU 6. Additionally, the parameters for source drive signal creation PRM are parameters that define a waveform shape of the source drive signal ODRV and the like.

The source drive signal creation unit 51 is respectively electrically connected to the power source line 501, which is a power supply pathway, and the power source line 502, which is a power discharge pathway.

Figure 18:
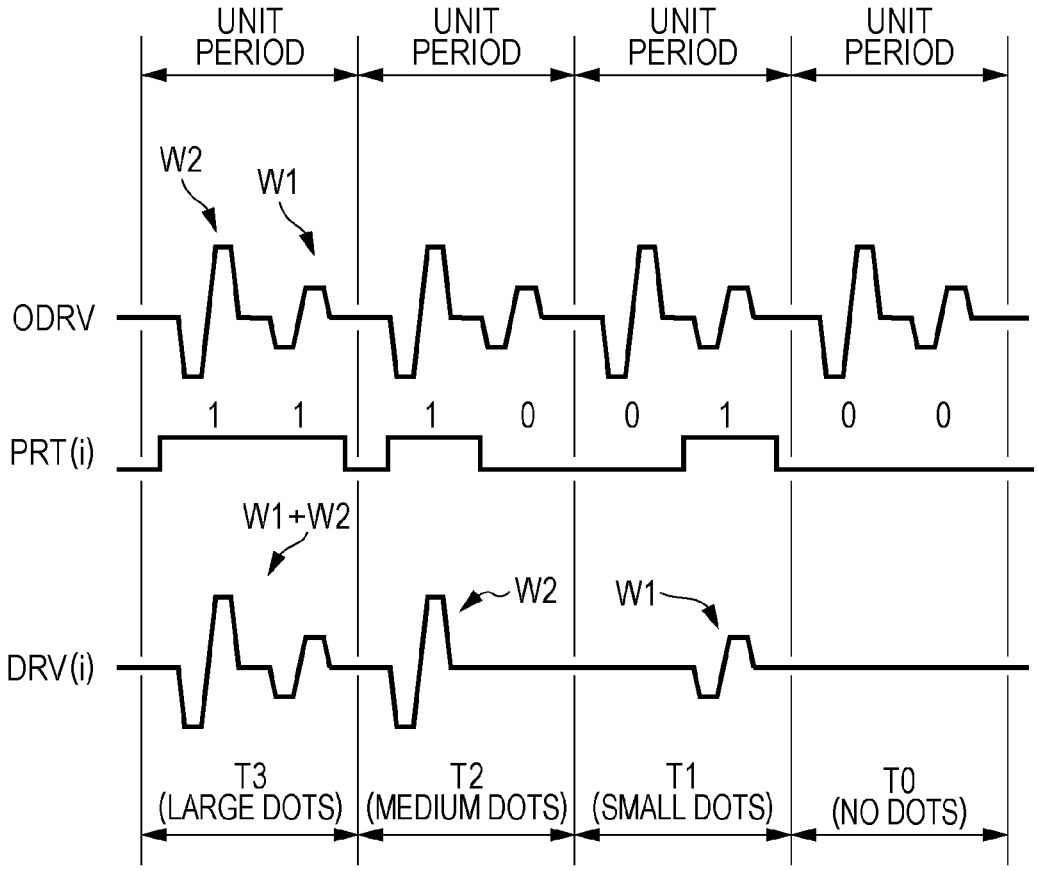
FIG. 18 is an explanatory drawing for describing a source drive signal, a printing signal and a drive signal.

FIG. 18 is a figure that shows examples of waveforms of the source drive signal ODRV, a printing signal PRT (i) and the drive signal DRV (i). The source drive signal ODRV is a signal that includes two pulses of a first pulse W1 and a second pulse W2 for each unit period (a period in which the carriage 32 traverses an interval of one pixel).

The drive signal DRV is created in the drive signal creation unit 52 on the basis of the printing signal PRT that is included in the control signal CtrH that is supplied from the CPU 6 and the source drive signal ODRV. The printing signal PRT is a signal that the CPU 6 creates on the basis of the printing data PD, and is a signal that defines the whether or not ink discharge is performed from the discharge unit D with respect to each pixel, and an ink discharge amount in a case in which ink is discharged from the discharge unit D.

More specifically, the drive signal creation unit 52 creates the drive signal DRV (i) by blocking or allowing the source drive signal ODRV to pass on the basis of the printing signal PRT (i) that corresponds to an $i^{th}$ discharge unit D among the M discharge units D. For example, as shown in FIG. 18, in a case in which the printing signal PRT (i) is a 2-bit signal, the drive signal creation unit 52 blocks both pulses W1 and W2 of the source drive signal ODRV in a case in which a value that shows the printing signal PRT (i) is "00", and in addition, only blocks the pulse W1 and allows the pulse W2 to pass in a case in which a value that shows the printing signal PRT (i) is "01", only blocks the pulse W2 and allows the pulse W1 to pass in a case in which a value that shows the printing signal PRT (i) is "10", and allows both pulses W1 and W2 to pass in a case in which a value that shows the printing signal PRT (i) is "11". Further, the drive signal creation unit 52 supplies the pulses that were allowed to pass to the upper part electrode 302 of the piezoelectric element 300 that the $i^{th}$ discharge unit D includes as the drive signal DRV (i). The $i^{th}$ discharge unit D is driven depending on the drive signal DRV (i) from the drive signal creation unit 52.

The drive signal creation unit 52 is respectively electrically connected to the power source line 501, which is a power supply pathway, and the power source line 502, which is a power discharge pathway. In addition, in each discharge unit D, the upper part electrode 302 of the piezoelectric element 300 is electrically connected to the drive signal creation unit 52 and receives the supply of the drive signal DRV, and the lower part electrode 301 is electrically connected to the power source line 502, which is a power discharge pathway.

Additionally, illustration thereof has been omitted from the drawings, but the head drive circuit 50 may be a circuit that has a DC-DC converter that converts a voltage that is established using the potential VDD and the standard voltage VSS into a suitable voltage that each unit of the head drive circuit 50 requires.

7. CONCLUSION OF EMBODIMENT

As has been described above, in the ink jet printer 1 according to the present embodiment, it is possible to deliver power to built-in components EB such as a head unit 5 that is built into a carriage 32 without using an FFC. Therefore, it is possible to improve the quality of printing in comparison with ink jet printers of the related art that deliver power to a head unit using an FFC, and furthermore, it is possible to reduce a frequency of breakdowns in the ink jet printer 1.

In addition, in the ink jet printer 1 according to the present embodiment, since the power source unit 10 supplies a suitable amount of power depending on the type of the recording medium P, in is possible to reduce the power consumption of the ink jet printer 1, and it is possible to suppress a circumstance in which there is a deficiency in the supply power to the head unit 5.

8. MODIFICATION EXAMPLES

Each of the abovementioned embodiments can be modified in a variety of ways. Aspects of specific modifications are exemplified below. The two or more aspects chosen arbitrarily from the following examples can be combined as appropriate within a range in which the aspects do not contradict one another. Additionally, in the Modification Examples that are described below, in order to avoid duplicate descriptions, the description of features that are common with the embodiment of the invention that is mentioned above have been omitted.

Modification Example 1

Figure 19:
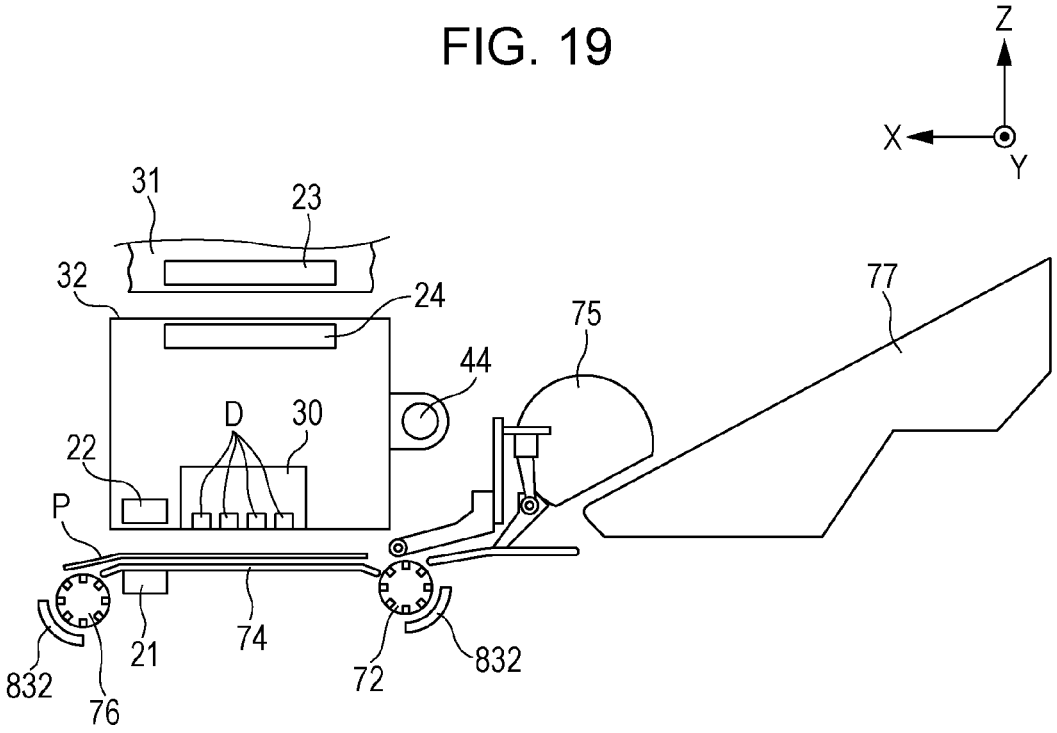
FIG. 19 is a schematic partial cross-sectional view of an ink jet printer according to Modification Example 1 of the invention.

In the abovementioned embodiments, both the conductor 21 and the conductor 23 are provided on a side that is on the opposite side of the transport pathway of the recording medium P when viewed from the carriage 32, which is a lower side of the carriage 32, but the invention is not limited to this kind of aspect, and either one of the conductor 21 and the conductor 23 may be provided on the housing 31 or on the carriage guiding shaft 44. For example, as shown in FIG. 19, in a case in which the conductor 23 is provided on the housing 31 or the carriage guiding shaft 44, the conductor 24 may be provided on the carriage 32 to face the conductor 23.

Modification Example 2

Figure 20:
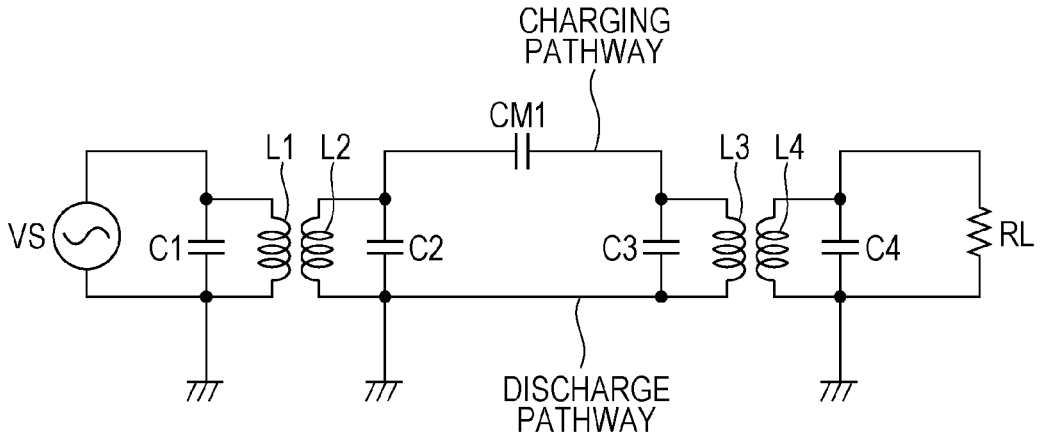
FIG. 20 is an equivalent circuit diagram of a power transmission unit in Modification Example 2 of the invention.

In the abovementioned embodiments and Modification Example, the power transmission unit 2 has the coupling capacitance CM1 of the power supply pathway and the coupling capacitance CM2 of the power discharge pathway, but the invention is not limited to this kind of aspect, and a configuration that has either one of the coupling capacitance CM1 and the coupling capacitance CM2 only, may be used. For example, as shown in FIG. 20, in the power transmission unit 2, an aspect in which the power discharge pathway is set to a grounding potential, and which has the coupling capacitance CM1 in the power supply pathway only may be used. In the example that is shown in FIG. 20, for example, the power discharge pathway may be set to a grounding potential by setting the potential of the carriage guiding shaft 44 to a grounding potential, and electrically connecting the terminal TE32 of the head unit 5 (refer to FIG. 8) to the carriage guiding shaft 44. Additionally, in the example that is shown in FIG. 20, a drive aspect of the power supply pathway is the same as that in the abovementioned embodiment.

Modification Example 3

In the abovementioned embodiments and Modification Examples, the power transmission unit 2 delivers power through a coupling capacitance (the coupling capacitance CM1 and the coupling capacitance CM2), but the invention is not limited to this kind of aspect, and the power transmission unit 2 may deliver power through electromagnetic coupling of at least two conductors.

For example, a configuration may be adopted in which an inductor is adopted as the conductor 21 and the conductor 22, and power is delivered due to mutual induction between the conductor 21 and the conductor 22. In this case, the power source unit 10 may be a unit that outputs a supply power Ws and a power source voltage VS with sizes that depend on the type of the recording medium P to the power transmission unit 2. More specifically, the power source unit 10 may be a unit that outputs a supply power Ws and a power source voltage VS that depend on a magnetic permeability of the recording medium P to the power transmission unit 2.

Modification Example 4

In the abovementioned embodiments and Modification Examples, the ink jet printer 1 is an ink jet printer that discharges ink via nozzles N by causing a piezoelectric element 300 to vibrate, but the invention is not limited to this kind of aspect, and for example, may be a so-called thermal type ink jet printer that increases an internal pressure inside the cavity 320 by generating bubbles inside the cavity 320 through heating of a heating body (not shown in the drawings) that is provided in the cavity 320, thereby discharging ink.

Modification Example 5

In the abovementioned embodiments and Modification Examples, the CPU 91 of the host computer 9 creates the recording medium data MD, but the CPU 6 of the ink jet printer 1 may create the recording medium data MD. In this case, a user of the ink jet printer 1 may choose a type of the recording medium P using the operation panel 84.

What is claimed is:

1. A printing apparatus that is capable of forming an image on a recording medium, which is in a transport pathway, by discharging a liquid onto the recording medium, the printing apparatus comprising:

a head unit that is provided with a discharge unit which discharges the liquid;

a carriage into which the head unit is built;

a power delivery unit that delivers at least a part of supplied power to the head unit; and a power supply unit that supplies power to the power delivery unit, wherein the power delivery unit is provided with a first conductor that is provided on a side that is opposite to a side of the carriage with the transport pathway interposed therebetween, and a second conductor that is provided in the carriage, wherein power that is supplied from the power supply unit is delivered to the head unit through a coupling capacitance that is formed by the first conductor and the second conductor, and wherein the power supply unit supplies different amounts of power to the power delivery unit depending on a type of recording medium that is in the transport pathway.

2. The printing apparatus according to claim 1, wherein the recording medium includes a first recording medium and a second recording medium that have dielectric constants that are higher than air, wherein the first recording medium is thicker than the second recording medium, and wherein a power that the power supply unit supplies to the power delivery unit in a case in which the recording medium that is in the transport pathway is the first recording medium is smaller than a power that the power supply unit supplies to the power delivery unit in a case in which the recording medium that is in the transport pathway is the second recording medium.

3. The printing apparatus according to claim 1, wherein the recording medium includes a first recording medium and a second recording medium that have dielectric constants that are higher than air, wherein the first recording medium has a higher dielectric constant than the second recording medium, and wherein a power that the power supply unit supplies to the power delivery unit in a case in which the recording medium that is in the transport pathway is the first recording medium is smaller than a power that the power supply unit supplies to the power delivery unit in a case in which the recording medium that is in the transport pathway is the second recording medium.

4. The printing apparatus according to claim 1, wherein the recording medium includes a first recording medium, which is a synthetic resin medium, and a second recording medium, which is a paper medium, and wherein a power that the power supply unit supplies to the power delivery unit in a case in which the recording medium that is in the transport pathway is the first recording medium is smaller than a power that the power supply unit supplies to the power delivery unit in a case in which the recording medium that is in the transport pathway is the second recording medium.

5. The printing apparatus according to claim 1, wherein the recording medium includes a first recording medium and a second recording medium, wherein the first recording medium is a paper medium that includes an ink reception layer configured to include synthetic silica, wherein the second recording medium is a paper medium that does not include the ink reception layer, and wherein a power that the power supply unit supplies to the power delivery unit in a case in which the recording medium that is in the transport pathway is the first recording medium is smaller than a power that the power supply unit supplies to the power delivery unit in a case in which the recording medium that is in the transport pathway is the second recording medium.

6. A printing apparatus that is capable of forming an image on a recording medium, which is in a transport pathway, by discharging a liquid onto the recording medium, the printing apparatus comprising:

a head unit that is provided with a discharge unit which discharges the liquid;

a carriage into which the head unit is built;

a power delivery unit that delivers at least a part of supplied power to the head unit; and a power supply unit that supplies power to the power delivery unit, wherein the power delivery unit is provided with a first conductor that is provided on a side that is opposite to a side of the carriage with the transport pathway interposed therebetween, and a second conductor that is provided in the carriage, wherein power that is supplied from the power supply unit is delivered to the head unit due to electromagnetic coupling of the first conductor and the second conductor, and wherein the power supply unit supplies different amounts of power to the power delivery unit depending on a type of recording medium that is in the transport pathway.

7. A control program for a printing apparatus that includes a head unit that is provided with a discharge unit which discharges a liquid on a recording medium which is in a transport pathway, a carriage into which the head unit is built, a power delivery unit that delivers at least a part of supplied power to the head unit, a power supply unit that supplies power to the power delivery unit, and a computer, in which the power delivery unit is provided with a first conductor that is provided on a side that is opposite to a side of the carriage with the transport pathway interposed therebetween, and a second conductor that is provided in the carriage, and in which the power delivery unit delivers power that is supplied from the power supply unit to the head unit through a coupling capacitance that is formed by the first conductor and the second conductor, wherein the control program causes the computer to function as a control unit that controls the power supply unit so that different amounts of power are supplied to the power delivery unit depending on a type of recording medium that is in the transport pathway.

* * * * *